US009638065B2

(12) United States Patent
Vermeersch et al.

(10) Patent No.: US 9,638,065 B2
(45) Date of Patent: May 2, 2017

(54) METHODS FOR REDUCING WEAR ON COMPONENTS OF A HEAT ENGINE SYSTEM AT STARTUP

(71) Applicant: Echogen Power Systems, LLC, Akron, OH (US)

(72) Inventors: Michael Louis Vermeersch, Ravenna, OH (US); Brett A. Bowan, Copley, OH (US); Swapnil Khairnar, Akron, OH (US)

(73) Assignee: Echogen Power Systems, LLC, Akron, OH (US)

( * ) Notice: Subject to any disclaimer, the term of this patent is extended or adjusted under 35 U.S.C. 154(b) by 384 days.

(21) Appl. No.: 14/164,496

(22) Filed: Jan. 27, 2014

(65) Prior Publication Data

US 2014/0208750 A1 Jul. 31, 2014

Related U.S. Application Data

(60) Provisional application No. 61/757,612, filed on Jan. 28, 2013, provisional application No. 61/757,629, filed on Jan. 28, 2013.

(51) Int. Cl.
*F01K 13/02* (2006.01)

(52) U.S. Cl.
CPC ..... *F01K 13/02* (2013.01)

(58) Field of Classification Search
CPC ..... F01K 25/103; F01K 13/02
USPC ..... 60/646–681
See application file for complete search history.

(56) References Cited

U.S. PATENT DOCUMENTS

| | | | |
|---|---|---|---|
| 2,575,478 | A | 11/1951 | Wilson |
| 2,634,375 | A | 4/1953 | Guimbal |
| 2,691,280 | A | 10/1954 | Albert |
| 3,095,274 | A | 6/1963 | Crawford |
| 3,105,748 | A | 10/1963 | Stahl |
| 3,237,403 | A | 3/1966 | Feher |
| 3,277,955 | A | 10/1966 | Laszlo |
| 3,401,277 | A | 9/1968 | Larson |
| 3,622,767 | A | 11/1971 | Koepcke |

(Continued)

FOREIGN PATENT DOCUMENTS

| | | | |
|---|---|---|---|
| CA | 2794150 | A1 | 11/2011 |
| CN | 1165238 | A | 11/1997 |

(Continued)

OTHER PUBLICATIONS

IST System Control Options & Results—Hexemer Et al (Aug. 29-30, 2009).*

(Continued)

*Primary Examiner* — Thai Ba Trieu
*Assistant Examiner* — Jessica Kebea
(74) *Attorney, Agent, or Firm* — Nolte & Associates, PC

(57) ABSTRACT

Provided herein are heat engine systems and methods for starting such systems and generating electricity while avoiding damage to one or more system components. A provided heat engine system maintains a working fluid (e.g., sc-$CO_2$) within the low pressure side of a working fluid circuit in a liquid-type state, such as a supercritical state, during a startup procedure. Additionally, a bypass system is provided for routing the working fluid around one or more heat exchangers during startup to avoid overheating of system components.

12 Claims, 9 Drawing Sheets

(56) References Cited

U.S. PATENT DOCUMENTS

| | | | |
|---|---|---|---|
| 3,630,022 | A | 12/1971 | Jubb |
| 3,736,745 | A | 6/1973 | Karig |
| 3,772,879 | A | 11/1973 | Engdahl |
| 3,791,137 | A | 2/1974 | Jubb |
| 3,830,062 | A | 8/1974 | Morgan et al. |
| 3,939,328 | A | 2/1976 | Davis |
| 3,971,211 | A | 7/1976 | Wethe |
| 3,982,379 | A | 9/1976 | Gilli |
| 3,998,058 | A | 12/1976 | Park |
| 4,009,575 | A | 3/1977 | Hartman, Jr. |
| 4,029,255 | A | 6/1977 | Heiser |
| 4,030,312 | A | 6/1977 | Wallin |
| 4,049,407 | A | 9/1977 | Bottum |
| 4,070,870 | A | 1/1978 | Bahel |
| 4,099,381 | A | 7/1978 | Rappoport |
| 4,119,140 | A | 10/1978 | Cates |
| 4,150,547 | A | 4/1979 | Hobson |
| 4,152,901 | A | 5/1979 | Munters |
| 4,164,848 | A | 8/1979 | Gilli |
| 4,164,849 | A | 8/1979 | Mangus |
| 4,170,435 | A | 10/1979 | Swearingen |
| 4,182,960 | A | 1/1980 | Reuyl |
| 4,183,220 | A | 1/1980 | Shaw |
| 4,198,827 | A | 4/1980 | Terry et al. |
| 4,208,882 | A | 6/1980 | Lopes et al. |
| 4,221,185 | A | 9/1980 | Scholes |
| 4,233,085 | A | 11/1980 | Roderick |
| 4,236,869 | A | 12/1980 | Laurello |
| 4,248,049 | A | 2/1981 | Briley |
| 4,257,232 | A | 3/1981 | Bell |
| 4,287,430 | A | 9/1981 | Guido |
| 4,336,692 | A | 6/1982 | Ecker |
| 4,347,711 | A | 9/1982 | Noe |
| 4,347,714 | A | 9/1982 | Kinsell |
| 4,372,125 | A | 2/1983 | Dickenson |
| 4,384,568 | A | 5/1983 | Palmatier |
| 4,391,101 | A | 7/1983 | Labbe |
| 4,420,947 | A | 12/1983 | Yoshino |
| 4,428,190 | A | 1/1984 | Bronicki |
| 4,433,554 | A | 2/1984 | Rojey |
| 4,439,687 | A | 3/1984 | Wood |
| 4,439,994 | A | 4/1984 | Briley |
| 4,448,033 | A | 5/1984 | Briccetti |
| 4,450,363 | A | 5/1984 | Russell |
| 4,455,836 | A | 6/1984 | Binstock |
| 4,467,609 | A | 8/1984 | Loomis |
| 4,467,621 | A | 8/1984 | O'Brien |
| 4,475,353 | A | 10/1984 | Lazare |
| 4,489,562 | A | 12/1984 | Snyder |
| 4,489,563 | A | 12/1984 | Kalina |
| 4,498,289 | A | 2/1985 | Osgerby |
| 4,516,403 | A | 5/1985 | Tanaka |
| 4,538,960 | A | 9/1985 | Iino |
| 4,549,401 | A | 10/1985 | Spliethoff |
| 4,555,905 | A | 12/1985 | Endou |
| 4,558,228 | A | 12/1985 | Larjola |
| 4,573,321 | A | 3/1986 | Knaebel |
| 4,578,953 | A | 4/1986 | Krieger |
| 4,589,255 | A | 5/1986 | Martens |
| 4,636,578 | A | 1/1987 | Feinberg |
| 4,674,297 | A | 6/1987 | Vobach |
| 4,694,189 | A | 9/1987 | Haraguchi |
| 4,697,981 | A | 10/1987 | Brown et al. |
| 4,700,543 | A | 10/1987 | Krieger |
| 4,730,977 | A | 3/1988 | Haaser |
| 4,756,162 | A | 7/1988 | Dayan |
| 4,765,143 | A | 8/1988 | Crawford |
| 4,773,212 | A | 9/1988 | Griffin |
| 4,798,056 | A | 1/1989 | Franklin |
| 4,813,242 | A | 3/1989 | Wicks |
| 4,821,514 | A | 4/1989 | Schmidt |
| 4,867,633 | A | 9/1989 | Gravelle |
| 4,892,459 | A | 1/1990 | Guelich |
| 4,986,071 | A | 1/1991 | Voss |
| 4,993,483 | A | 2/1991 | Harris |
| 5,000,003 | A | 3/1991 | Wicks |
| 5,050,375 | A | 9/1991 | Dickinson |
| 5,083,425 | A | 1/1992 | Hendriks et al. |
| 5,098,194 | A | 3/1992 | Kuo |
| 5,102,295 | A | 4/1992 | Pope |
| 5,104,284 | A | 4/1992 | Hustak, Jr. |
| 5,164,020 | A | 11/1992 | Wagner |
| 5,176,321 | A | 1/1993 | Doherty |
| 5,203,159 | A | 4/1993 | Koizumi et al. |
| 5,228,310 | A | 7/1993 | Vandenberg |
| 5,291,960 | A | 3/1994 | Brandenburg |
| 5,320,482 | A | 6/1994 | Palmer et al. |
| 5,335,510 | A | 8/1994 | Rockenfeller |
| 5,358,378 | A | 10/1994 | Holscher |
| 5,360,057 | A | 11/1994 | Rockenfeller |
| 5,392,606 | A | 2/1995 | Labinov |
| 5,440,882 | A | 8/1995 | Kalina |
| 5,444,972 | A | 8/1995 | Moore |
| 5,483,797 | A | 1/1996 | Rigal et al. |
| 5,488,828 | A | 2/1996 | Brossard |
| 5,490,386 | A | 2/1996 | Keller |
| 5,503,222 | A | 4/1996 | Dunne |
| 5,531,073 | A | 7/1996 | Bronicki |
| 5,538,564 | A | 7/1996 | Kaschmitter |
| 5,542,203 | A | 8/1996 | Luoma |
| 5,570,578 | A | 11/1996 | Saujet |
| 5,588,298 | A | 12/1996 | Kalina |
| 5,600,967 | A | 2/1997 | Meckler |
| 5,634,340 | A | 6/1997 | Grennan |
| 5,647,221 | A | 7/1997 | Garris, Jr. |
| 5,649,426 | A | 7/1997 | Kalina |
| 5,676,382 | A | 10/1997 | Dahlheimer |
| 5,680,753 | A | 10/1997 | Hollinger |
| 5,738,164 | A | 4/1998 | Hildebrand |
| 5,754,613 | A | 5/1998 | Hashiguchi |
| 5,771,700 | A | 6/1998 | Cochran |
| 5,789,822 | A | 8/1998 | Calistrat |
| 5,813,215 | A | 9/1998 | Weisser |
| 5,833,876 | A | 11/1998 | Schnur |
| 5,862,666 | A | 1/1999 | Liu |
| 5,873,260 | A | 2/1999 | Linhardt |
| 5,874,039 | A | 2/1999 | Edelson |
| 5,894,836 | A | 4/1999 | Wu |
| 5,899,067 | A | 5/1999 | Hageman |
| 5,903,060 | A | 5/1999 | Norton |
| 5,918,460 | A | 7/1999 | Connell |
| 5,941,238 | A | 8/1999 | Tracy |
| 5,943,869 | A | 8/1999 | Cheng |
| 5,946,931 | A | 9/1999 | Lomax |
| 5,973,050 | A | 10/1999 | Johnson |
| 6,037,683 | A | 3/2000 | Lulay |
| 6,041,604 | A | 3/2000 | Nicodemus |
| 6,058,930 | A | 5/2000 | Shingleton |
| 6,062,815 | A | 5/2000 | Holt |
| 6,065,280 | A | 5/2000 | Ranasinghe |
| 6,066,797 | A | 5/2000 | Toyomura |
| 6,070,405 | A | 6/2000 | Jerye |
| 6,082,110 | A | 7/2000 | Rosenblatt |
| 6,105,368 | A | 8/2000 | Hansen |
| 6,112,547 | A | 9/2000 | Spauschus |
| 6,129,507 | A | 10/2000 | Ganelin |
| 6,158,237 | A | 12/2000 | Riffat |
| 6,164,655 | A | 12/2000 | Bothien |
| 6,202,782 | B1 | 3/2001 | Hatanaka |
| 6,223,846 | B1 | 5/2001 | Schechter |
| 6,233,938 | B1 | 5/2001 | Nicodemus |
| 6,282,900 | B1 | 9/2001 | Bell |
| 6,282,917 | B1 | 9/2001 | Mongan |
| 6,295,818 | B1 | 10/2001 | Ansley |
| 6,299,690 | B1 | 10/2001 | Mongeon |
| 6,341,781 | B1 | 1/2002 | Matz |
| 6,374,630 | B1 | 4/2002 | Jones |
| 6,393,851 | B1 | 5/2002 | Wightman |
| 6,432,320 | B1 | 8/2002 | Bonsignore |
| 6,434,955 | B1 | 8/2002 | Ng |
| 6,442,951 | B1 | 9/2002 | Maeda |
| 6,446,425 | B1 | 9/2002 | Lawlor |
| 6,446,465 | B1 | 9/2002 | Dubar |
| 6,463,730 | B1 | 10/2002 | Keller |

(56) References Cited

U.S. PATENT DOCUMENTS 6,484,490 B1 11/2002 Olsen
6,539,720 B2 4/2003 Rouse et al.
6,539,728 B2 4/2003 Korin
6,571,548 B1 6/2003 Bronicki
6,581,384 B1 6/2003 Benson
6,598,397 B2 7/2003 Hanna
6,644,062 B1 11/2003 Hays
6,657,849 B1 12/2003 Andresakis
6,668,554 B1 12/2003 Brown
6,684,625 B2 2/2004 Kline
6,695,974 B2 2/2004 Withers
6,715,294 B2 4/2004 Anderson
6,734,585 B2 5/2004 Tornquist
6,735,948 B1 5/2004 Kalina
6,739,142 B2 5/2004 Korin
6,751,959 B1 6/2004 McClanahan et al.
6,769,256 B1 8/2004 Kalina
6,799,892 B2 10/2004 Leuthold
6,808,179 B1 10/2004 Bhattacharyya
6,810,335 B2 10/2004 Lysaght
6,817,185 B2 11/2004 Coney
6,857,268 B2 2/2005 Stinger
6,910,334 B2 6/2005 Kalina
6,918,254 B2 7/2005 Baker
6,921,518 B2 7/2005 Johnston
6,941,757 B2 9/2005 Kalina
6,960,839 B2 11/2005 Zimron
6,960,840 B2 11/2005 Willis
6,962,054 B1 11/2005 Linney
6,964,168 B1 11/2005 Pierson
6,968,690 B2 11/2005 Kalina
6,986,251 B2 1/2006 Radcliff
7,013,205 B1 3/2006 Hafner et al.
7,021,060 B1 4/2006 Kalina
7,022,294 B2 4/2006 Johnston
7,033,553 B2 4/2006 Johnston et al.
7,036,315 B2 5/2006 Kang
7,041,272 B2 5/2006 Keefer
7,047,744 B1 5/2006 Robertson
7,048,782 B1 5/2006 Couch
7,062,913 B2 6/2006 Christensen
7,096,665 B2 8/2006 Stinger
7,096,679 B2 8/2006 Manole
7,124,587 B1 10/2006 Linney
7,174,715 B2 2/2007 Armitage
7,194,863 B2 3/2007 Ganev
7,197,876 B1 4/2007 Kalina
7,200,996 B2 4/2007 Cogswell
7,234,314 B1 6/2007 Wiggs
7,249,588 B2 7/2007 Russell
7,278,267 B2 10/2007 Yamada
7,279,800 B2 10/2007 Bassett
7,287,381 B1 10/2007 Pierson
7,305,829 B2 12/2007 Mirolli
7,313,926 B2 1/2008 Gurin
7,340,894 B2 3/2008 Miyahara et al.
7,340,897 B2 3/2008 Zimron
7,406,830 B2 8/2008 Valentian
7,416,137 B2 8/2008 Hagen et al.
7,453,242 B2 11/2008 Ichinose
7,458,217 B2 12/2008 Kalina
7,458,218 B2 12/2008 Kalina
7,464,551 B2 12/2008 Althaus et al.
7,469,542 B2 12/2008 Kalina
7,516,619 B2 4/2009 Pelletier
7,600,394 B2 10/2009 Kalina
7,621,133 B2 11/2009 Tomlinson
7,654,354 B1 2/2010 Otterstrom
7,665,291 B2 2/2010 Anand
7,665,304 B2 2/2010 Sundel
7,685,820 B2 * 3/2010 Litwin ..... F02C 1/05 60/641.11
7,685,821 B2 3/2010 Kalina
7,730,713 B2 6/2010 Nakano
7,735,335 B2 6/2010 Uno
7,770,376 B1 8/2010 Brostmeyer
7,775,758 B2 8/2010 Legare
7,827,791 B2 11/2010 Pierson
7,838,470 B2 11/2010 Shaw
7,841,179 B2 11/2010 Kalina
7,841,306 B2 11/2010 Myers
7,854,587 B2 12/2010 Ito
7,866,157 B2 1/2011 Ernst
7,900,450 B2 3/2011 Gurin
7,950,230 B2 5/2011 Nishikawa
7,950,243 B2 5/2011 Gurin
7,972,529 B2 7/2011 Machado
7,997,076 B2 8/2011 Ernst
8,096,128 B2 1/2012 Held et al.
8,099,198 B2 1/2012 Gurin
8,146,360 B2 4/2012 Myers
8,281,593 B2 10/2012 Held
8,419,936 B2 4/2013 Berger et al.
8,820,083 B2 * 9/2014 Davidson ..... H02J 4/00 60/671
2001/0015061 A1 8/2001 Viteri et al.
2001/0020444 A1 9/2001 Johnston
2001/0030952 A1 10/2001 Roy
2002/0029558 A1 3/2002 Tamaro
2002/0066270 A1 6/2002 Rouse et al.
2002/0078696 A1 6/2002 Korin
2002/0078697 A1 6/2002 Lifson
2002/0082747 A1 6/2002 Kramer
2003/0000213 A1 1/2003 Christensen
2003/0061823 A1 4/2003 Alden
2003/0154718 A1 8/2003 Nayar
2003/0182946 A1 10/2003 Sami
2003/0213246 A1 11/2003 Coll et al.
2003/0221438 A1 12/2003 Rane et al.
2004/0011038 A1 1/2004 Stinger
2004/0011039 A1 1/2004 Stinger et al.
2004/0020185 A1 2/2004 Brouillette et al.
2004/0020206 A1 2/2004 Sullivan et al.
2004/0021182 A1 2/2004 Green et al.
2004/0035117 A1 2/2004 Rosen
2004/0083731 A1 5/2004 Lasker
2004/0083732 A1 5/2004 Hanna et al.
2004/0088992 A1 5/2004 Brasz et al.
2004/0097388 A1 5/2004 Brask et al.
2004/0105980 A1 6/2004 Sudarshan et al.
2004/0107700 A1 6/2004 McClanahan et al.
2004/0159110 A1 8/2004 Janssen
2004/0211182 A1 10/2004 Gould
2005/0022963 A1 2/2005 Garrabrant et al.
2005/0056001 A1 3/2005 Frutschi
2005/0096676 A1 5/2005 Gifford, III et al.
2005/0109387 A1 5/2005 Marshall
2005/0137777 A1 6/2005 Kolavennu et al.
2005/0162018 A1 7/2005 Realmuto et al.
2005/0167169 A1 8/2005 Gering et al.
2005/0183421 A1 8/2005 Vaynberg et al.
2005/0196676 A1 9/2005 Singh et al.
2005/0198959 A1 9/2005 Schubert
2005/0227187 A1 10/2005 Schilling
2005/0252235 A1 11/2005 Critoph et al.
2005/0257812 A1 11/2005 Wright et al.
2006/0010868 A1 1/2006 Smith
2006/0060333 A1 3/2006 Chordia et al.
2006/0066113 A1 3/2006 Ebrahim et al.
2006/0080960 A1 4/2006 Rajendran et al.
2006/0112693 A1 6/2006 Sundel
2006/0182680 A1 8/2006 Keefer et al.
2006/0211871 A1 9/2006 Dai et al.
2006/0213218 A1 9/2006 Uno et al.
2006/0225421 A1 10/2006 Yamanaka et al.
2006/0225459 A1 10/2006 Meyer
2006/0249020 A1 11/2006 Tonkovich et al.
2006/0254281 A1 11/2006 Badeer et al.
2007/0001766 A1 1/2007 Ripley et al.
2007/0017192 A1 1/2007 Bednarek et al.
2007/0019708 A1 1/2007 Shiflett et al.
2007/0027038 A1 2/2007 Kamimura et al.
2007/0056290 A1 3/2007 Dahm
2007/0089449 A1 4/2007 Gurin

(56) References Cited

U.S. PATENT DOCUMENTS

| | | | |
|---|---|---|---|
| 2007/0108200 | A1 | 5/2007 | McKinzie, II |
| 2007/0119175 | A1 | 5/2007 | Ruggieri et al. |
| 2007/0130952 | A1 | 6/2007 | Copen |
| 2007/0151244 | A1 | 7/2007 | Gurin |
| 2007/0161095 | A1 | 7/2007 | Gurin |
| 2007/0163261 | A1 | 7/2007 | Strathman |
| 2007/0195152 | A1 | 8/2007 | Kawai et al. |
| 2007/0204620 | A1 | 9/2007 | Pronske et al. |
| 2007/0227472 | A1 | 10/2007 | Takeuchi et al. |
| 2007/0234722 | A1 | 10/2007 | Kalina |
| 2007/0245733 | A1 | 10/2007 | Pierson et al. |
| 2007/0246206 | A1 | 10/2007 | Gong et al. |
| 2008/0000225 | A1 | 1/2008 | Kalina |
| 2008/0006040 | A1 | 1/2008 | Peterson et al. |
| 2008/0010967 | A1 | 1/2008 | Griffin et al. |
| 2008/0023666 | A1 | 1/2008 | Gurin |
| 2008/0053095 | A1 | 3/2008 | Kalina |
| 2008/0066470 | A1 | 3/2008 | MacKnight |
| 2008/0135253 | A1 | 6/2008 | Vinegar et al. |
| 2008/0163625 | A1 | 7/2008 | O'Brien |
| 2008/0173450 | A1 | 7/2008 | Goldberg et al. |
| 2008/0211230 | A1 | 9/2008 | Gurin |
| 2008/0250789 | A1 | 10/2008 | Myers et al. |
| 2008/0252078 | A1 | 10/2008 | Myers |
| 2009/0021251 | A1 | 1/2009 | Simon |
| 2009/0085709 | A1 | 4/2009 | Meinke |
| 2009/0107144 | A1 | 4/2009 | Moghtaderi et al. |
| 2009/0139234 | A1 | 6/2009 | Gurin |
| 2009/0139781 | A1 | 6/2009 | Straubel |
| 2009/0173337 | A1 | 7/2009 | Tamaura et al. |
| 2009/0173486 | A1 | 7/2009 | Copeland |
| 2009/0180903 | A1 | 7/2009 | Martin et al. |
| 2009/0205892 | A1 | 8/2009 | Jensen et al. |
| 2009/0211251 | A1 | 8/2009 | Peterson et al. |
| 2009/0211253 | A1 | 8/2009 | Radcliff et al. |
| 2009/0266075 | A1 | 10/2009 | Westmeier et al. |
| 2009/0293503 | A1 | 12/2009 | Vandor |
| 2010/0024421 | A1 | 2/2010 | Litwin |
| 2010/0077792 | A1 | 4/2010 | Gurin |
| 2010/0083662 | A1 | 4/2010 | Kalina |
| 2010/0102008 | A1 | 4/2010 | Hedberg |
| 2010/0122533 | A1 | 5/2010 | Kalina |
| 2010/0146949 | A1 | 6/2010 | Stobart et al. |
| 2010/0146973 | A1 | 6/2010 | Kalina |
| 2010/0156112 | A1 | 6/2010 | Held et al. |
| 2010/0162721 | A1 | 7/2010 | Welch et al. |
| 2010/0205962 | A1 | 8/2010 | Kalina |
| 2010/0218513 | A1 | 9/2010 | Vaisman et al. |
| 2010/0218930 | A1 | 9/2010 | Proeschel |
| 2010/0263380 | A1 | 10/2010 | Biederman et al. |
| 2010/0287934 | A1 | 11/2010 | Glynn et al. |
| 2010/0300093 | A1 | 12/2010 | Doty |
| 2010/0326076 | A1 | 12/2010 | Ast et al. |
| 2011/0027064 | A1 | 2/2011 | Pal et al. |
| 2011/0030404 | A1 | 2/2011 | Gurin |
| 2011/0048012 | A1 | 3/2011 | Ernst et al. |
| 2011/0061384 | A1 | 3/2011 | Held et al. |
| 2011/0061387 | A1 | 3/2011 | Held et al. |
| 2011/0088399 | A1 | 4/2011 | Briesch et al. |
| 2011/0179799 | A1 | 7/2011 | Allam et al. |
| 2011/0185729 | A1 | 8/2011 | Held |
| 2011/0192163 | A1 | 8/2011 | Kasuya |
| 2011/0203278 | A1 | 8/2011 | Kopecek et al. |
| 2011/0259010 | A1 | 10/2011 | Bronicki et al. |
| 2011/0299972 | A1 | 12/2011 | Morris |
| 2011/0308253 | A1 | 12/2011 | Ritter |
| 2012/0047892 | A1 | 3/2012 | Held et al. |
| 2012/0067055 | A1 | 3/2012 | Held |
| 2012/0128463 | A1 | 5/2012 | Held |
| 2012/0131918 | A1 | 5/2012 | Held |
| 2012/0131919 | A1 | 5/2012 | Held |
| 2012/0131920 | A1 | 5/2012 | Held |
| 2012/0131921 | A1 | 5/2012 | Held |
| 2012/0159922 | A1 | 6/2012 | Gurin |
| 2012/0159956 | A1 | 6/2012 | Gurin |
| 2012/0174558 | A1 | 7/2012 | Gurin |
| 2012/0186219 | A1 | 7/2012 | Gurin |
| 2012/0247134 | A1 | 10/2012 | Gurin |
| 2012/0247455 | A1 | 10/2012 | Gurin et al. |
| 2012/0261090 | A1 | 10/2012 | Durmaz et al. |
| 2013/0019597 | A1 | 1/2013 | Kalina |
| 2013/0033037 | A1 | 2/2013 | Held et al. |
| 2013/0036736 | A1 | 2/2013 | Hart et al. |
| 2013/0113221 | A1 | 5/2013 | Held |
| 2014/0216034 | A1* | 8/2014 | Numata ..... F02C 3/34 60/653 |
| 2016/0017759 | A1* | 1/2016 | Gayawal ..... F01K 13/02 60/670 |
| 2016/0040557 | A1* | 2/2016 | Vermeersch ..... F01K 7/06 60/653 |

FOREIGN PATENT DOCUMENTS

| | | | |
|---|---|---|---|
| CN | 1432102 | A | 7/2003 |
| CN | 101614139 | A | 12/2009 |
| CN | 202055876 | U | 11/2011 |
| CN | 202544943 | U | 11/2012 |
| CN | 202718721 | U | 2/2013 |
| DE | 2632777 | A1 | 2/1977 |
| DE | 19906087 | A1 | 8/2000 |
| DE | 10052993 | A1 | 5/2002 |
| EP | 1977174 | A2 | 10/2008 |
| EP | 1998013 | A2 | 12/2008 |
| EP | 2419621 | A1 | 2/2012 |
| EP | 2446122 | A1 | 5/2012 |
| EP | 2478201 | A1 | 7/2012 |
| EP | 2500530 | A1 | 9/2012 |
| EP | 2550436 | A1 | 1/2013 |
| GB | 856985 | A | 12/1960 |
| GB | 2010974 | A | 7/1979 |
| GB | 2075608 | A | 11/1981 |
| JP | 58-193051 | A | 11/1983 |
| JP | 60-040707 | A | 3/1985 |
| JP | 61-152914 | A | 7/1986 |
| JP | 01-240705 | A | 9/1989 |
| JP | 05-321612 | A | 12/1993 |
| JP | 06-331225 | A | 11/1994 |
| JP | 08-028805 | A | 2/1996 |
| JP | 09-100702 | A | 4/1997 |
| JP | 2641581 | B2 | 5/1997 |
| JP | 09-209716 | A | 8/1997 |
| JP | 2858750 | B2 | 12/1998 |
| JP | H11-270352 | | 5/1999 |
| JP | 2000-257407 | A | 9/2000 |
| JP | 2001-193419 | A | 7/2001 |
| JP | 2002-097965 | A | 4/2002 |
| JP | 2003-529715 | A | 10/2003 |
| JP | 2004-239250 | A | 8/2004 |
| JP | 2004-332626 | A | 11/2004 |
| JP | 2005-030727 | A | 2/2005 |
| JP | 2005-533972 | A1 | 11/2005 |
| JP | 2006-037760 | A | 2/2006 |
| JP | 2006-177266 | A | 7/2006 |
| JP | 2007-198200 | A | 9/2007 |
| JP | 4343738 | B2 | 10/2009 |
| JP | 2011-017268 | A | 1/2011 |
| KR | 10-0191080 | | 6/1999 |
| KR | 10-20070086244 | A | 8/2007 |
| KR | 10-0766101 | B1 | 10/2007 |
| KR | 10-0844634 | A | 7/2008 |
| KR | 10-20100067927 | A | 6/2010 |
| KR | 10-20110018769 | A | 2/2011 |
| KR | 1069914 | B1 | 9/2011 |
| KR | 1103549 | B1 | 1/2012 |
| KR | 10-20120058582 | A | 6/2012 |
| KR | 2012-0068670 | A | 6/2012 |
| KR | 2012-0128753 | A | 11/2012 |
| KR | 2012-0128755 | A | 11/2012 |
| WO | 91-05145 | A1 | 4/1991 |
| WO | 96-09500 | A1 | 3/1996 |
| WO | 00-71944 | A1 | 11/2000 |
| WO | 01-44658 | A1 | 6/2001 |
| WO | 2006-060253 | A1 | 6/2006 |
| WO | 2006-137957 | A1 | 12/2006 |

(56) References Cited

FOREIGN PATENT DOCUMENTS

| | | | | |
|---|---|---|---|---|
| WO | 2007-056241 | A2 | 5/2007 | |
| WO | 2007-079245 | A2 | 7/2007 | |
| WO | 2007-082103 | A2 | 7/2007 | |
| WO | 2007-112090 | A2 | 10/2007 | |
| WO | 2008-039725 | A2 | 4/2008 | |
| WO | 2008-101711 | A2 | 8/2008 | |
| WO | 2009-045196 | A1 | 4/2009 | |
| WO | 2009-058992 | A2 | 5/2009 | |
| WO | 2010-074173 | A1 | 7/2010 | |
| WO | 2010-083198 | A1 | 7/2010 | |
| WO | 2010-121255 | A1 | 10/2010 | |
| WO | 2010-126980 | A2 | 11/2010 | |
| WO | 2010-151560 | A1 | 12/2010 | |
| WO | 2011-017450 | A2 | 2/2011 | |
| WO | 2011-017476 | A1 | 2/2011 | |
| WO | 2011-017599 | A1 | 2/2011 | |
| WO | 2011-034984 | A1 | 3/2011 | |
| WO | 2011-094294 | A2 | 8/2011 | |
| WO | 2011-119650 | A2 | 9/2011 | |
| WO | WO 2011119650 | A2 * | 9/2011 | ..... F01K 23/04 |
| WO | 2012-074905 | A2 | 6/2012 | |
| WO | 2012-074907 | A2 | 6/2012 | |
| WO | 2012-074911 | A2 | 6/2012 | |
| WO | 2012-074940 | A2 | 6/2012 | |
| WO | 2013-055391 | A1 | 4/2013 | |
| WO | 2013-059687 | A1 | 4/2013 | |
| WO | 2013-059695 | A1 | 4/2013 | |
| WO | 2013-070249 | A1 | 5/2013 | |
| WO | 2013-074907 | A1 | 5/2013 | |

OTHER PUBLICATIONS

Integrated Systems Test (IST) S-CO2 Brayton Loop Transient Model Description and Intial Results—Hexemer et al (Apr. 2009).*
150 kwe Supercritical Closed Cycle System—Hoffman et al Transactions of the ASME, Jan. 1971 pp. 70-80.*
PCT/US2010/044681—International Search Report and Written Opinion dated Oct. 7, 2010, 10 pages.
PCT/US2010/044681—International Preliminary Report on Patentability dated Feb. 16, 2012, 9 pages.
PCT/US2010/049042—International Search Report and Written Opinion dated Nov. 17, 2010, 11 pages.
PCT/US2010/049042—International Preliminary Report on Patentability dated Mar. 29, 2012, 18 pages.
PCT/US2011/029486—International Preliminary Report on Patentability dated Sep. 25, 2012, 6 pages.
PCT/US2011/029486—International Search Report and Written Opinion dated Nov. 16, 2011, 9 pages.
PCT/US2011/062266—International Search Report and Written Opinion dated Jul. 9, 2012, 12 pages.
PCT/US2011/062198—International Search Report and Written Opinion dated Jul. 2, 2012, 9 pages.
PCT/US2011/062198—Extended European Search Report dated May 6, 2014, 9 pages.
PCT/US2011/062201—International Search Report and Written Opinion dated Jun. 26, 2012, 9 pages.
PCT/US2011/062201—Extended European Search Report dated May 28, 2014, 8 pages.
PCT/US2011/062204—International Search Report dated Nov. 1, 2012, 10 pages.
PCT/US2011/62207—International Search Report and Written Opinion dated Jun. 28, 2012, 7 pages.
PCT/US2012/000470—International Search Report dated Mar. 8, 2013, 10 pages.
PCT/US2012/061151—International Search Report and Written Opinion dated Feb. 25, 2013, 9 pages.
PCT/US2012/061159—International Search Report dated Mar. 2, 2013, 10 pages.
PCT/US2013/055547—Notification of Transmittal of the International Search Report and the Written Opinion of the International Searching Authority, or the Declaration dated Jan. 24, 2014, 11 pages.
PCT/US2013/064470—Notification of Transmittal of the International Search Report and the Written Opinion of the International Searching Authority, or the Declaration dated Jan. 22, 2014, 10 pages.
PCT/US2013/064471—Notification of Transmittal of the International Search Report and the Written Opinion of the International Searching Authority, or the Declaration dated Jan. 24, 2014, 10 pages.
PCT/US2014/013154—International Search Report dated May 23, 2014, 4 pages.
PCT/US2014/013170—Notification of Transmittal of the International Search Report and the Written Opinion of the International Searching Authority, or the Declaration, dated May 9, 2014, 12 pages.
PCT/US2014/023026—Notification of Transmittal of the International Search Report and the Written Opinion of the International Searching Authority, or the Declaration dated Jul. 22, 2014, 11 pages.
PCT/US2014/023990—Notification of Transmittal of the International Search Report and the Written Opinion of the International Searching Authority, or the Declaration dated Jul. 17, 2014, 10 pages.
PCT/US2014/026173—Notification of Transmittal of the International Search Report and the Written Opinion of the International Searching Authority, or the Declaration dated Jul. 9, 2014, 10 pages.
Persichilli, Michael, et al., "Supercritical CO2 Power Cycle Developments and Commercialization: Why SCO2 can Displace Steam", Echogen Power Systems, LLC, Power-Gen India & Central Asia 2012, Apr. 19-21, 2012, New Delhi, India, 15 pages.
Renz, Manfred, "The New Generation Kalina Cycle", Contribution to the Conference: Electricity Generation from Enhanced Geothermal Systems, Sep. 14, 2006, Strasbourg, France, 18 pages.
Saari, Henry, et al., "Supercritical CO2 Advanced Brayton Cycle Design", Presentation, Carleton University, Supercritical CO2 Power Cycle Symposium, May 24-25, 2011, Boulder, CO, 21 pages.
San Andres, Luis, "Start-Up Response of Fluid Film Lubricated Cryogenic Turbopumps (Preprint)", AIAA/ASME/SAE/ASEE Joint Propulsion Conference, Cincinnati, OH, Jul. 8-11, 2007, 38 pages.
Sarkar, J. and Bhattacharyya, Souvik, "Optimization of Recompression S-CO2 Power Cycle with Reheating", Energy Conversion and Management 50, May 17, 2009, pp. 1939-1945.
Thorin, Eva, "Power Cycles with Ammonia-Water Mixtures as Working Fluid", Doctoral Thesis, Department of Chemical Engineering and Technology Energy Processes, Royal Institute of Technology, Stockholm, Sweden, 2000, 66 pages.
Tom, Samsun Kwok Sun, "The Feasibility of Using Supercritical Carbon Dioxide as a Coolant for the Candu Reactor", The University of British Columbia, Jan. 1978, 156 pages.
VGB Powertech Service GmbH, "CO2 Capture and Storage", A VGB Report on the State of the Art, Aug. 25, 2004, 112 pages.
Vidhi, Rachana, et al., "Study of Supercritical Carbon Dioxide Power Cycle for Power Conversion from Low Grade Heat Sources", Presentation, University of South Florida and Oak Ridge National Laboratory, Supercritical CO2 Power Cycle Symposium, May 24-25, 2011, Boulder, CO, 17 pages.
Vidhi, Rachana, et al., "Study of Supercritical Carbon Dioxide Power Cycle for Power Conversion from Low Grade Heat Sources", Paper, University of South Florida and Oak Ridge National Laboratory, Supercritical CO2 Power Cycle Symposium, May 24-25, 2011, Boulder, CO, 8 pages.
Wright, Steven A., et al., "Modeling and Experimental Results for Condensing Supercritical CO2 Power Cycles", Sandia Report, Jan. 2011, 47 pages.
Wright, Steven A., et al., "Supercritical CO2 Power Cycle Development Summary at Sandia National Laboratories", May 24-25, 2011, 1 page, (Abstract Only).
Wright, Steven, "Mighty Mite", Mechanical Engineering, Jan. 2012, pp. 41-43.
Yoon, Ho Joon, et al., "Preliminary Results of Optimal Pressure Ratio for Supercritical CO2 Brayton Cycle Coupled with Small Modular Water Cooled Reactor", Presentation, Korea Advanced

(56) References Cited

OTHER PUBLICATIONS

Institute of Science and Technology and Khalifa University of Science, Technology and Research, Boulder, CO, May 25, 2011, 18 pages.
Yoon, Ho Joon, et al., "Preliminary Results of Optimal Pressure Ratio for Supercritical CO2 Brayton Cycle Coupled with Small Modular Water Cooled Reactor", Paper, Korea Advanced Institute of Science and Technology and Khalifa University of Science, Technology and Research, May 24-25, 2011, Boulder, CO, 7 pages.
Alpy, N., et al., "French Atomic Energy Commission views as regards to SCO2 Cycle Development priorities and related R&D approach", Presentation, Symposium on SCO2 Power Cycles, Apr. 29-30, 2009, Troy, NY, 20 pages.
Angelino, G. and Invernizzi, C.M., "Carbon Dioxide Power Cycles using Liquid Natural Gas as Heat Sink", Applied Thermal Engineering, Mar. 3, 2009, 43 pages.
Bryant, John C., Saari, Henry, and Zanganeh, Kourosh, "An Analysis and Comparison of the Simple and Recompression Supercritical CO2 Cycles", Supercritical CO2 Power Cycle Symposium, May 24-25, 2011, Boulder, CO, 8 pages.
Chapman, Daniel J., Arias, Diego A., "An Assessment of the Supercritical Carbon Dioxide Cycle for Use in a Solar Parabolic Trough Power Plant", Presentation, Abengoa Solar, Apr. 29-30, 2009, Troy, NY, 20 pages.
Chapman, Daniel J., Arias, Diego A., "An Assessment of the Supercritical Carbon Dioxide Cycle for Use in a Solar Parabolic Trough Power Plant", Paper, Abengoa Solar, Apr. 29-30, 2009, Troy, NY, 5 pages.
Chen, Yang, Lundqvist, P., Johansson, A., Platell, P., "A Comparative Study of the Carbon Dioxide Transcritical Power Cycle Compared with an Organic Rankine Cycle with R123 as Working Fluid in Waste Heat Recovery", Science Direct, Applied Thermal Engineering, Jun. 12, 2006, 6 pages.
Chen, Yang, "Thermodynamic Cycles Using Carbon Dioxide as Working Fluid", Doctoral Thesis, School of Industrial Engineering and Management, Stockholm, Oct. 2011, 150 pages, (3 parts).
Chinese Search Report for Application No. 201080035382.1, 2 pages.
Chinese Search Report for Application No. 201080050795.7, 2 pages.
Chordia, Lalit, "Optimizing Equipment for Supercritical Applications", Thar Energy LLC, Supercritical CO2 Power Cycle Symposium, May 24-25, 2011, Boulder, CO, 7 pages.
Combs, Osie V., "An Investigation of the Supercritical CO2 Cycle (Feher cycle) for Shipboard Application", Massachusetts Institute of Technology, May 1977, 290 pages.
Di Bella, Francis A., "A Gas Turbine Engine Exhaust Waste Heat Recovery Navy Shipboard Module Development", Supercritical CO2 Power Cycle Symposium, May 24-25, 2011, Boulder, CO, 8 pages.
Dostal, V., et al., "A Supercritical Carbon Dioxide Cycle for Next Generation Nuclear Reactors", Mar. 10, 2004, 326 pages, (7 parts).
Dostal, Vaclav and Kulhanek, Martin, "Research on the Supercritical Carbon Dioxide Cycles in the Czech Republic", Czech Technical University in Prague, Symposium on SCO2 Power Cycles, Apr. 29-30, Troy, NY, 8 pages.
Dostal, Vaclav, and Dostal, Jan, "Supercritical CO2 Regeneration Bypass Cycle—Comparison to Traditional Layouts", Supercritical CO2 Power Cycle Symposium, May 24-25, 2011, Boulder, CO, 5 pages.
Eisemann, Kevin, and Fuller, Robert L., "Supercritical CO2 Brayton Cycle Design and System Start-up Options", Barber Nichols, Inc., Paper, Supercritical CO2 Power Cycle Symposium, May 24-25, 2011, Boulder, CO, 7 pages.
Eisemann, Kevin, and Fuller, Robert L., "Supercritical CO2 Brayton Cycle Design and System Start-up Options", Presentation, Supercritical CO2 Power Cycle Symposium, May 24-25, 2011, Boulder, CO, 11 pages.
Feher, E.G., et al., "Investigation of Supercritical (Feher) Cycle", Astropower Laboratory, Missile & Space Systems Division, Oct. 1968, 152 pages.
Fuller, Robert L. and Eisemann, Kevin, "Centrifugal Compressor Off-Design Performance for Super-Critical CO2", Barber Nichols, Inc. Presentation, Supercritical CO2 Power Cycle Symposium, May 24-25, 2011, Boulder, CO, 20 pages.
Fuller, Robert L. and Eisemann, Kevin, "Centrifugal Compressor Off-Design Performance for Super-Critical CO2", Paper, Supercritical CO2 Power Cycle Symposium, May 24-25, 2011, Boulder, CO, 12 pages.
Gokhstein, D.P. and Verkhivker, G.P., "Use of Carbon Dioxide as a Heat Carrier and Working Substance in Atomic Power Stations", Soviet Atomic Energy, Apr. 1969, vol. 26, Issue 4, pp. 430-432.
Gokhstein, D.P., Taubman, E.I., Konyaeva, G.P., "Thermodynamic Cycles of Carbon Dioxide Plant with an Additional Turbine After the Regenerator", Energy Citations Database, Mar. 1973, 1 page, Abstract only.
Hejzlar, P., et al., "Assessment of Gas Cooled Gas Reactor with Indirect Supercritical CO2 Cycle", Massachusetts Institute of Technology, Jan. 2006, 10 pages.
Jeong, Woo Seok, et al., "Performance of S-CO2 Brayton Cycle with Additive Gases for SFR Application", Korea Advanced Institute of Science and Technology, Supercritical CO2 Power Cycle Symposium, May 24-25, 2011, Boulder, CO, 5 pages.
Johnson, Gregory A. & McDowell, Michael, "Issues Associated with Coupling Supercritical CO2 Power Cycles to Nuclear, Solar and Fossil Fuel Heat Sources", Hamilton Sundstrand, Energy Space & Defense-Rocketdyne, Apr. 29-30, 2009, Troy, NY, Presentation, 18 pages.
Kawakubo, Tomoki, "Unsteady Roto-Stator Interaction of a Radial-Inflow Turbine with Variable Nozzle Vanes", ASME Turbo Expo 2010: Power for Land, Sea, and Air; vol. 7: Turbomachinery, Parts A, B, and C; Glasgow, UK, Jun. 14-18, 2010, Paper No. GT2010-23677, pp. 2075-2084, 1 page, (Abstract only).
Kulhanek, Martin, "Thermodynamic Analysis and Comparison of S-CO2 Cycles", Presentation, Czech Technical University in Prague, Supercritical CO2 Power Cycle Symposium, May 24-25, 2011, Boulder, CO, 14 pages.
Kulhanek, Martin, "Thermodynamic Analysis and Comparison of S-CO2 Cycles", Paper, Czech Technical University in Prague, Supercritical CO2 Power Cycle Symposium, May 24-25, 2011, Boulder, CO, 7 pages.
Kulhanek, Martin and Dostal, Vaclav, "Supercritical Carbon Dioxide Cycles Thermodynamic Analysis and Comparison", Abstract, Faculty Conference held in Prague, Mar. 24, 2009, 13 pages.
Ma, Zhiwen and Turchi, Craig S., "Advanced Supercritical Carbon Dioxide Power Cycle Configurations for Use in Concentrating Solar Power Systems", National Renewable Energy Laboratory, Supercritical CO2 Power Cycle Symposium, May 24-25, 2011, Boulder, CO, 4 pages.
Moisseytsev, Anton and Sienicki, Jim, "Investigation of Alternative Layouts for the Supercritical Carbon Dioxide Brayton Cycle for a Sodium-Cooled Fast Reactor", Supercritical CO2 Power Cycle Symposium, Troy, NY, Apr. 29, 2009, 26 pages.
Munoz De Escalona, Jose M., "The Potential of the Supercritical Carbon Dioxide Cycle in High Temperature Fuel Cell Hybrid Systems", Paper, Thermal Power Group, University of Seville, Supercritical CO2 Power Cycle Symposium, May 24-25, 2011, Boulder, CO, 6 pages.
Munoz De Escalona, Jose M., et al., "The Potential of the Supercritical Carbon Dioxide Cycle in High Temperature Fuel Cell Hybrid Systems", Presentation, Thermal Power Group, University of Seville, Supercritical CO2 Power Cycle Symposium, May 24-25, 2011, Boulder, CO, 19 pages.
Muto, Y., et al., "Application of Supercritical CO2 Gas Turbine for the Fossil Fired Thermal Plant", Journal of Energy and Power Engineering, Sep. 30, 2010, vol. 4, No. 9, 9 pages.
Muto, Yasushi and Kato, Yasuyoshi, "Optimal Cycle Scheme of Direct Cycle Supercritical CO2 Gas Turbine for Nuclear Power

(56) References Cited

OTHER PUBLICATIONS

Generation Systems", International Conference on Power Engineering-2007, Oct. 23-27, 2007, Hangzhou, China, pp. 86-87.
Noriega, Bahamonde J.S., "Design Method for S-CO2 Gas Turbine Power Plants", Master of Science Thesis, Delft University of Technology, Oct. 2012, 122 pages, (3 parts).
Oh, Chang, et al., "Development of a Supercritical Carbon Dioxide Brayton Cycle: Improving PBR Efficiency and Testing Material Compatibility", Presentation, Nuclear Energy Research Initiative Report, Oct. 2004, 38 pages.
Oh, Chang, et al., "Development of a Supercritical Carbon Dioxide Brayton Cycle: Improving VHTR Efficiency and Testing Material Compatibility", Presentation, Nuclear Energy Research Initiative Report, Final Report, Mar. 2006, 97 pages.
Parma, Ed, et al., "Supercritical CO2 Direct Cycle Gas Fast Reactor (SC-GFR) Concept", Presentation for Supercritical CO2 Power Cycle Symposium, May 24-25, 2011, Boulder, CO, 40 pages.
Parma, Ed, et al., "Supercritical CO2 Direct Cycle Gas Fast Reactor (SC-GFR) Concept", Supercritical CO2 Power Cycle Symposium, May 24-25, 2011, Boulder, CO, 9 pages.
Parma, Edward J., et al., "Supercritical CO2 Direct Cycle Gas Fast Reactor (SC-GFR) Concept", Presentation, Sandia National Laboratories, May 2011, 55 pages.
PCT/US2006/049623—Written Opinion of ISA dated Jan. 4, 2008, 4 pages.
PCT/US2007/001120—International Search Report dated Apr. 25, 2008, 7 pages.
PCT/US2007/079318—International Preliminary Report on Patentability dated Jul. 7, 2008, 5 pages.
PCT/US2010/0131614—International Search Report dated Jul. 12, 2010, 3 pages.
PCT/US2010/031614—International Preliminary Report on Patentability dated Oct. 27, 2011, 9 pages.
PCT/US2010/039559—International Preliminary Report on Patentability dated Jan. 12, 2012, 7 pages.
PCT/US2010/039559—Notification of Transmittal of the International Search Report and the Written Opinion of the International Searching Authority, or the Declaration dated Sep. 1, 2010, 6 pages.
PCT/US2010/044476—International Search Report dated Sep. 29, 2010, 23 pages.

* cited by examiner

METHODS FOR REDUCING WEAR ON COMPONENTS OF A HEAT ENGINE SYSTEM AT STARTUP

CROSS-REFERENCE TO RELATED APPLICATIONS

This application claims the benefit of U.S. Prov. Appl. No. 61/757,612, filed on Jan. 28, 2013, the contents of which are hereby incorporated by reference to the extent not inconsistent with the present disclosure. This application also claims the benefit of U.S. Prov. Appl. No. 61/757,629, filed on Jan. 28, 2013, the contents of which are hereby incorporated by reference to the extent not inconsistent with the present disclosure.

BACKGROUND

Waste heat is often created as a byproduct of industrial processes where flowing streams of high-temperature liquids, gases, or fluids must be exhausted into the environment or removed in some way in an effort to maintain the operating temperatures of the industrial process equipment. Some industrial processes utilize heat exchanger devices to capture and recycle waste heat back into the process via other process streams. However, the capturing and recycling of waste heat is generally infeasible by industrial processes that utilize high temperatures or have insufficient mass flow or other unfavorable conditions.

Waste heat can be converted into useful energy by a variety of turbine generator or heat engine systems that employ thermodynamic methods, such as Rankine cycles. Rankine cycles and similar thermodynamic methods are typically steam-based processes that recover and utilize waste heat to generate steam for driving a turbine, turbo, or other expander connected to an electric generator or pump. An organic Rankine cycle utilizes a lower boiling-point working fluid, instead of water, during a traditional Rankine cycle. Exemplary lower boiling-point working fluids include hydrocarbons, such as light hydrocarbons (e.g., propane or butane) and halogenated hydrocarbon, such as hydrochlorofluorocarbons (HCFCs) or hydrofluorocarbons (HFCs) (e.g., R245fa). More recently, in view of issues such as thermal instability, toxicity, flammability, and production cost of the lower boiling-point working fluids, some thermodynamic cycles have been modified to circulate non-hydrocarbon working fluids, such as ammonia.

During a typical startup procedure, various components of the heat engine system begin to warm up, and the flow of the working fluid through a working fluid circuit is initiated. However, the waste heat flue is usually immediately operational at the beginning of the startup procedure. The thermal energy in the waste heat stream may cause immediate heat soaking of a heat exchanger provided to transfer heat from the waste heat stream to the working fluid. If the working fluid absorbs excess energy from the heat exchanger during the startup procedure, the properties of the working fluid may be disadvantageously altered, and one or more components of the heat engine system may be subject to damage or wear.

For example, if the working fluid absorbs excess thermal energy, then the working fluid may change to a different state of matter that is outside the scope of the system design. For further example, if a generator system requires the working fluid in a supercritical state, once overheated, the working fluid may have a subcritical, gaseous, or other state. Further, the overheated working fluid may escape by rupturing seals, valves, conduits, and connectors throughout the generally closed generator system, thus causing damage and expense. Additionally, the increased thermal stress can cause failure of fragile mechanical parts of the turbine power generator system. For example, the fins or blades of a turbo or turbine unit in the generator system may crack and disintegrate upon exposure to too much heat and stress. An overspeed situation is another expected problem upon the absorption of too much thermal energy by the turbine power generator system. During an overspeed situation, the rotational speed of the power turbine, the power generator, and/or the drive shaft becomes too fast and further accelerates the flow and increases the temperature of the working fluid and, if not controlled, generally leads to catastrophic system failure.

Additional concerns may arise during the startup procedure because the working fluid may change from a vapor phase to a liquid phase on a low pressure side of the fluid circuit, and the pressure of the liquid must be raised on the high pressure side of the circuit. Raising the pressure of a liquid phase by pumping generally requires less work per unit mass of working fluid than raising the pressure of a vapor phase by compression, and pumping also results in a higher overall cycle efficiency. Unfortunately, one consequence of pumping is that bubbles may form if the working fluid drops below the saturation temperature and pressure for the specific working fluid. Such bubbles may cause or otherwise form cavitation of the pump used to circulate the working fluid in the fluid circuit, thus leading to flow reduction and, in some cases, catastrophic damage to the pump and shutdown of the heat engine system.

Therefore, there is a need for systems and methods for generating electrical energy in which temperatures and pressures within a working fluid circuit are controlled to reduce or eliminate thermal stress on vulnerable mechanical parts of the heat engine system during a startup procedure.

SUMMARY

Embodiments of the invention generally provide heat engine systems and methods for starting heat engine systems and generating electricity. In one embodiment described herein, the method for starting a heat engine system is provided and includes circulating a working fluid within a working fluid circuit by a pump system, such that the working fluid circuit has a high pressure side containing the working fluid in a supercritical state, a low pressure side containing the working fluid in a subcritical state or a supercritical state, and the pump system may contain a turbopump, a start pump, other pumps, or combinations thereof. The method further includes transferring thermal energy from a heat source stream to the working fluid by at least a primary heat exchanger fluidly coupled to and in thermal communication with the high pressure side of the working fluid circuit and flowing the working fluid through a power turbine or through a power turbine bypass line circumventing the power turbine. The power turbine may be configured to convert the thermal energy from the working fluid to mechanical energy of the power turbine and the power turbine is coupled to a power generator configured to convert the mechanical energy into electrical energy. In addition, the method includes monitoring and maintaining a pump suction pressure of the working fluid within the low pressure side of the working fluid circuit upstream to an inlet on a pump portion of the turbopump via a process control system operatively connected to the working fluid circuit. Generally, the inlet on the pump portion of the turbopump and the low pressure side of the working fluid circuit contain the working fluid in the supercritical state during a startup procedure. Therefore, the pump suction pressure may be maintained at but generally greater than the critical pressure of the working fluid during the startup procedure.

In other embodiments, a method for starting a heat engine system is provided and includes circulating a working fluid within a working fluid circuit by a pump system, such that the working fluid circuit has a high pressure side containing the working fluid in a supercritical state and a low pressure side containing the working fluid in a subcritical state or a supercritical state. The method further includes transferring thermal energy from a heat source stream to the working fluid by at least a primary heat exchanger fluidly coupled to and in thermal communication with the high pressure side of the working fluid circuit and flowing the working fluid through a power turbine or through a power turbine bypass line circumventing the power turbine. Generally, the power turbine may be configured to convert the thermal energy from the working fluid to mechanical energy of the power turbine and the power turbine is coupled to a power generator configured to convert the mechanical energy into electrical energy.

Additionally, the method further includes monitoring and maintaining a pressure of the working fluid within the low pressure side of the working fluid circuit via a process control system operatively connected to the working fluid circuit, such that the low pressure side of the working fluid circuit contains the working fluid in the supercritical state during a startup procedure. The working fluid in the low pressure side is maintained at least at the critical pressure, but generally above the critical pressure of the working fluid during the startup procedure. In some embodiments, such as for the working fluid containing carbon dioxide and disposed within the low pressure side, the value of the critical pressure is generally greater than 5 MPa, such as about 7 MPa or greater, for example, about 7.38 MPa. Therefore, the working fluid in the low pressure side may be maintained at a pressure within a range from about 5 MPa to about 15 MPa, more narrowly within a range from about 7 MPa to about 12 MPa, more narrowly within a range from about 7.38 MPa to about 10.4 MPa, and more narrowly within a range from about 7.38 MPa to about 8 MPa during the startup procedure, in some examples.

The method may further include increasing the flowrate or temperature of the working fluid within the working fluid circuit and circulating the working fluid by a turbopump contained within the pump system during the startup procedure. In some configurations, the pump system of the heat engine system may have one or more pumps, such as a turbopump, a mechanical start pump, an electric start pump, or a combination of a turbo pump and a start pump.

The method may also include circulating the working fluid by the turbopump during a load ramp procedure or a full load procedure subsequent to the startup procedure, such that the flowrate or temperature of the working fluid sustains the turbopump during the load ramp procedure or the full load procedure. In some configurations, the heat engine system may have a secondary heat exchanger and/or a tertiary heat exchanger configured to heat the working fluid. Generally, the secondary heat exchanger and/or the tertiary heat exchanger may be configured to heat the working fluid upstream to an inlet on a drive turbine of the turbopump, such as during the load ramp procedure or the full load procedure. In some examples, at least one of the primary heat exchanger, the secondary heat exchanger, and/or the tertiary heat exchanger may reach a steady state during the load ramp procedure or the full load procedure.

In other embodiments, the method includes decreasing the pressure of the working fluid within the low pressure side of the working fluid circuit via the process control system during the load ramp procedure or the full load procedure. The method may also include decreasing the pressure of the working fluid within the low pressure side of the working fluid circuit via the process control system during the load ramp procedure or the full load procedure. In many examples, the working fluid within the low pressure side of the working fluid circuit is in a subcritical state during the load ramp procedure or the full load procedure. The working fluid in the subcritical state is generally in a liquid state and free or substantially free of a gaseous state. Therefore, the working fluid in the subcritical state is generally free or substantially free of bubbles. In many examples, the working fluid contains carbon dioxide.

In other embodiments, the method further includes detecting an undesirable value of the pressure via the process control system, wherein the undesirable value is less than a predetermined threshold value of the pressure, modulating at least one valve fluidly coupled to the working fluid circuit with the process control system to increase the pressure by increasing the flowrate of the working fluid passing through the at least one valve, and detecting a desirable value of the pressure via the process control system, wherein the desirable value is at or greater than the predetermined threshold value of the pressure.

In some examples, the method further includes measuring the pressure (e.g., the pump suction pressure) of the working fluid within the low pressure side of the working fluid circuit upstream to an inlet on a pump portion of a turbopump. The pump suction pressure may be at the critical pressure of the working fluid, but generally, the pump suction pressure is greater than the critical pressure of the working fluid at the inlet on the pump portion of the turbopump. In other examples, the method further includes measuring the pressure of the working fluid downstream from a turbine outlet on the power turbine within the low pressure side of the working fluid circuit. In other examples, the method further includes maintaining the pressure of the working fluid at or greater than a critical pressure value during the startup procedure. Alternatively, in other examples, the method may further include maintaining the pressure of the working fluid at less than the critical pressure value during the load ramp procedure or the full load procedure.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

As described in more detail below, presently disclosed embodiments are directed to heat engine systems and methods for efficiently transforming thermal energy of a heat stream (e.g., a waste heat stream) into valuable electrical energy. The provided embodiments enable the reduction or prevention of damage to components of the heat engine systems during a startup period. For example, in one embodiment, a heat engine system is configured to maintain a working fluid (e.g., sc-$CO_2$) within the low pressure side of a working fluid circuit in a liquid-type state, such as a supercritical state, during a startup procedure. The pump suction pressure at the pump inlet of a turbopump or other circulation pump is maintained, adjusted, or otherwise controlled at or greater than the critical pressure of the working fluid during the startup procedure. Therefore, the working fluid may be kept in a supercritical state free or substantially free of gaseous bubbles within the low pressure side of the working fluid circuit to avoid pump cavitation of the circulation pump.

For further example, in other embodiments, a bypass valve and a bypass line are provided for directing the working fluid around one or more heat exchangers, which transfer heat from the waste heat flue to the working fluid, to avoid excessively heating the working fluid while the heat engine system is warming up during startup. In some embodiments, the bypass line and the bypass valve may be fluidly coupled to the working fluid circuit upstream to the one or more heat exchangers, configured to circumvent the flow of the working fluid around at least one or more of the heat exchangers, and configured to provide the flow of the working fluid to a primary heat exchanger. One end of the bypass line may be coupled to the working fluid circuit upstream to the two or more heat exchangers and the other end of the bypass line may be coupled to the working fluid circuit downstream from the one or more of the heat exchangers and upstream to the primary heat exchanger. As the heat engine system approaches full power, the bypass line and the bypass valve are utilized to provide additional control while managing the rising temperature of the working fluid circuit in order to prevent the working fluid from getting too hot and to reduce or eliminate thermal stress on a turbopump used for circulating the working fluid.

Figure 1:
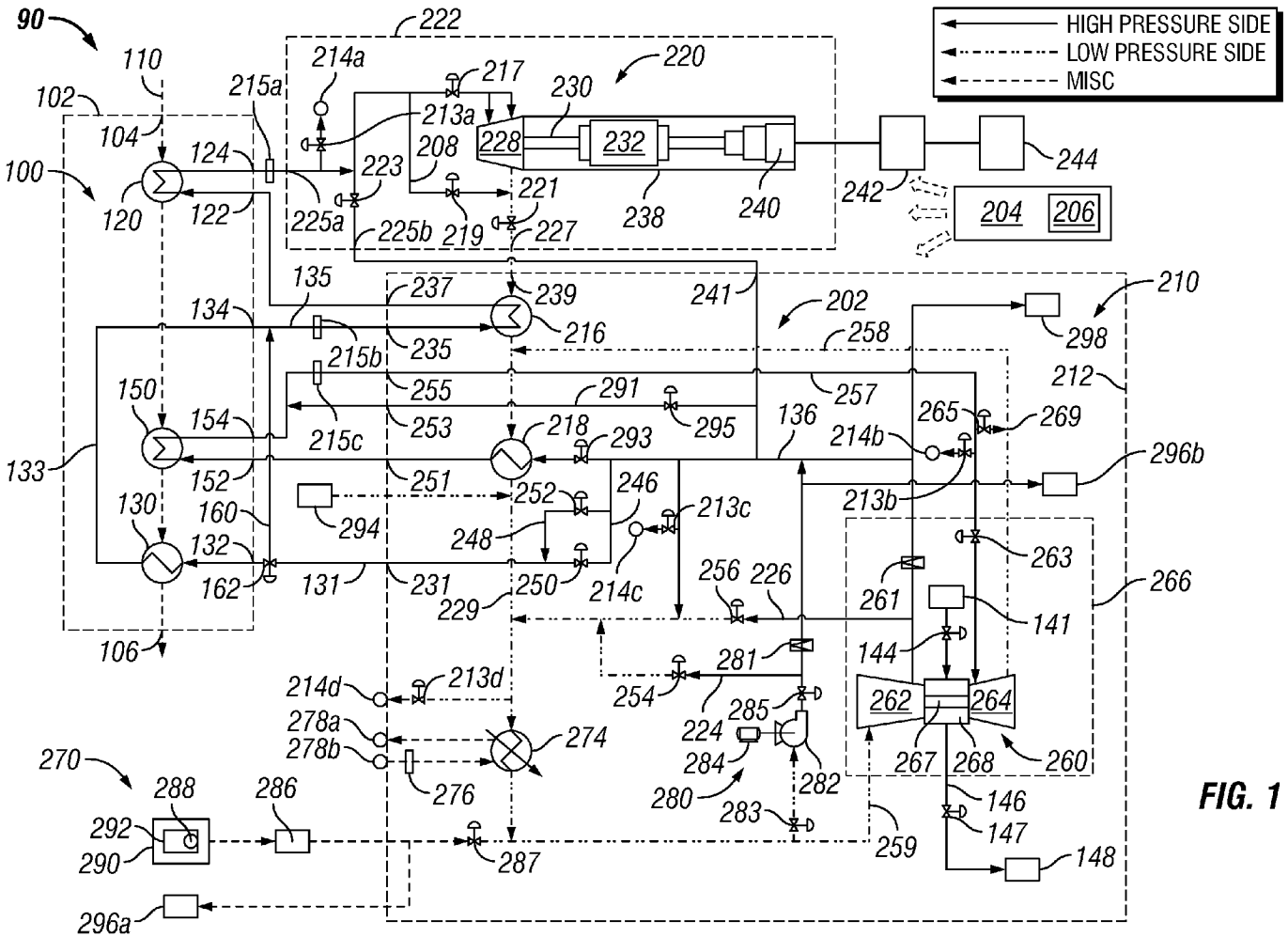
FIG. 1 illustrates an embodiment of a heat engine system according to one or more embodiments disclosed herein.
Figure 2:
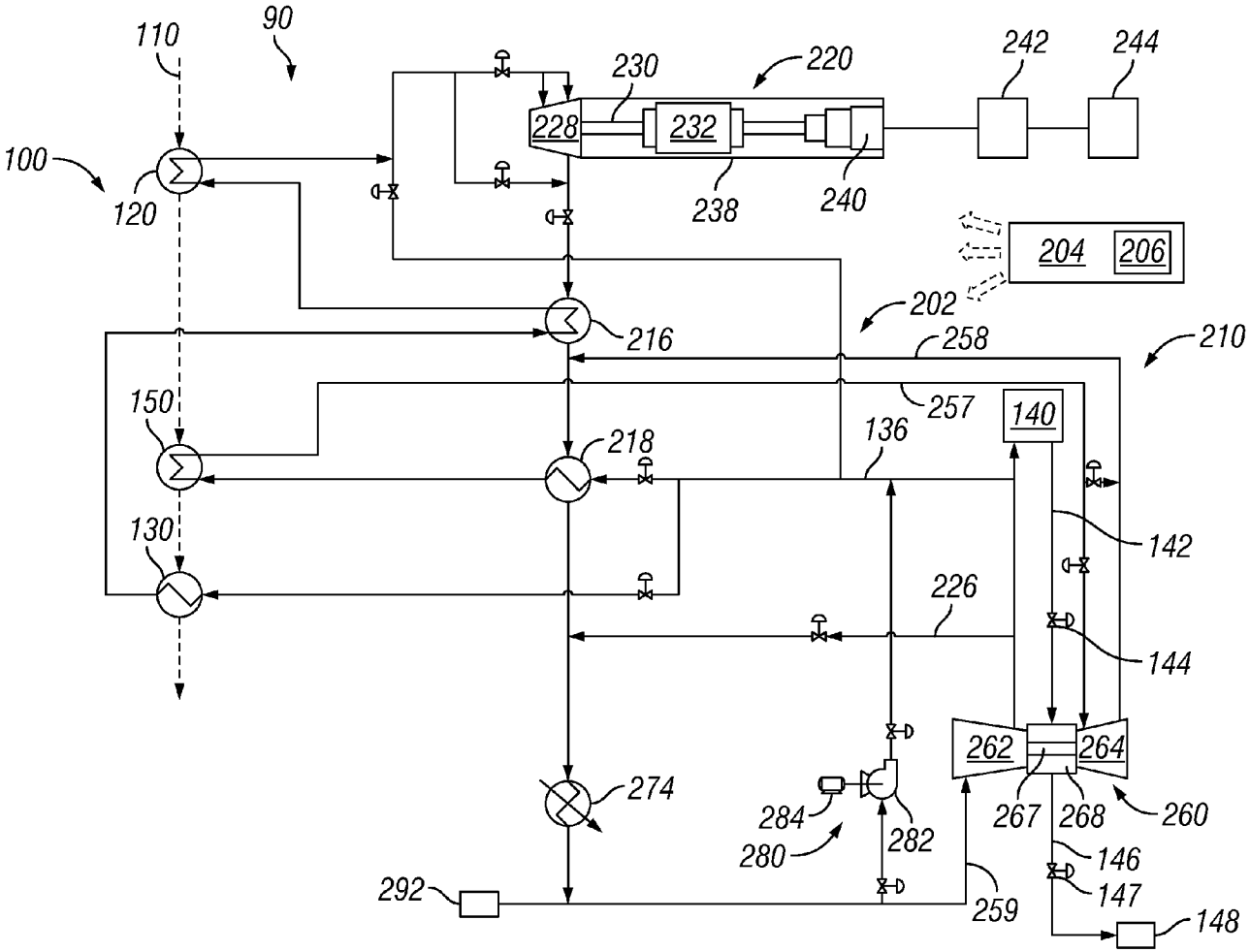
FIG. 2 illustrates an embodiment of a heat engine system for maintaining a working fluid in a supercritical state during a startup period.

Turning now to the drawings, FIGS. 1 and 2 illustrate an embodiment of a heat engine system 90, which may also be referred to as a thermal engine system, an electrical generation system, a waste heat or other heat recovery system, and/or a thermal to electrical energy system, as described in one or more embodiments below. The heat engine system 90 is generally configured to encompass one or more elements of a Rankine cycle, a derivative of a Rankine cycle, or another thermodynamic cycle for generating electrical energy from a wide range of thermal sources. The heat engine system 90 includes a waste heat system 100 and a power generation system 90 coupled to and in thermal communication with each other via a working fluid circuit 202 disposed within a process system 210. During operation, a working fluid, such as supercritical carbon dioxide (sc-$CO_2$), is circulated through the working fluid circuit 202, and heat is transferred to the working fluid from a heat source stream 110 flowing through the waste heat system 100. Once heated, the working fluid is circulated through a power turbine 228 within the power generation system 90 where the thermal energy contained in the heated working fluid is converted to mechanical energy. In this way, the process system 210, the waste heat system 100, and the power generation system 90 cooperate to convert the thermal energy in the heat source stream 110 into mechanical energy, which may be further converted into electrical energy if desired, depending on implementation-specific considerations.

More specifically, in the embodiment of FIG. 1, the waste heat system 100 contains three heat exchangers (i.e., the heat exchangers 120, 130, and 150) fluidly coupled to a high pressure side of the working fluid circuit 202 and in thermal communication with the heat source stream 110. Such thermal communication provides the transfer of thermal energy from the heat source stream 110 to the working fluid flowing throughout the working fluid circuit 202. In one or more embodiments disclosed herein, two, three, or more heat exchangers may be fluidly coupled to and in thermal communication with the working fluid circuit 202, such as a primary heat exchanger, a secondary heat exchanger, a tertiary heat exchanger, respectively the heat exchangers 120, 150, and 130. For example, the heat exchanger 120 may be the primary heat exchanger fluidly coupled to the working fluid circuit 202 upstream to an inlet of the power turbine 228, the heat exchanger 150 may be the secondary heat exchanger fluidly coupled to the working fluid circuit 202 upstream to an inlet of the drive turbine 264 of the turbine pump 260, and the heat exchanger 130 may be the tertiary heat exchanger fluidly coupled to the working fluid circuit 202 upstream to an inlet of the heat exchanger 120. However, it should be noted that in other embodiments, any desired number of heat exchangers, not limited to three, may be provided in the waste heat system 100.

Further, the waste heat system 100 also contains an inlet 104 for receiving the heat source stream 110 and an outlet 106 for passing the heat source stream 110 out of the waste heat system 100. The heat source stream 110 flows through and from the inlet 104, through the heat exchanger 120, through one or more additional heat exchangers, if fluidly coupled to the heat source stream 110, and to and through the outlet 106. In some examples, the heat source stream 110 flows through and from the inlet 104, through the heat exchangers 120, 150, and 130, respectively, and to and through the outlet 106. The heat source stream 110 may be routed to flow through the heat exchangers 120, 130, 150, and/or additional heat exchangers in other desired orders.

In some embodiments described herein, the waste heat system 100 is disposed on or in a waste heat skid 102 fluidly coupled to the working fluid circuit 202, as well as other portions, sub-systems, or devices of the heat engine system 90. The waste heat skid 102 may be fluidly coupled to a source of and an exhaust for the heat source stream 110, a main process skid 212, a power generation skid 222, and/or other portions, sub-systems, or devices of the heat engine system 90.

In one or more configurations, the waste heat system 100 disposed on or in the waste heat skid 102 generally contains inlets 122, 132, and 152 and outlets 124, 134, and 154 fluidly coupled to and in thermal communication with the working fluid within the working fluid circuit 202. The inlet 122 is disposed upstream to the heat exchanger 120 and the outlet 124 is disposed downstream from the heat exchanger 120. The working fluid circuit 202 is configured to flow the working fluid from the inlet 122, through the heat exchanger 120, and to the outlet 124 while transferring thermal energy from the heat source stream 110 to the working fluid by the heat exchanger 120. The inlet 152 is disposed upstream to the heat exchanger 150 and the outlet 154 is disposed downstream from the heat exchanger 150. The working fluid circuit 202 is configured to flow the working fluid from the inlet 152, through the heat exchanger 150, and to the outlet 154 while transferring thermal energy from the heat source stream 110 to the working fluid by the heat exchanger 150. The inlet 132 is disposed upstream to the heat exchanger 130 and the outlet 134 is disposed downstream from the heat exchanger 130. The working fluid circuit 202 is configured to flow the working fluid from the inlet 132, through the heat exchanger 130, and to the outlet 134 while transferring thermal energy from the heat source stream 110 to the working fluid by the heat exchanger 130.

The heat source stream 110 that flows through the waste heat system 100 may be a waste heat stream such as, but not limited to, gas turbine exhaust stream, industrial process exhaust stream, or other combustion product exhaust streams, such as furnace or boiler exhaust streams. The heat source stream 110 may be at a temperature within a range from about 100° C. to about 1,000° C., or greater than 1,000° C., and in some examples, within a range from about 200° C. to about 800° C., more narrowly within a range from about 300° C. to about 600° C. The heat source stream 110 may contain air, carbon dioxide, carbon monoxide, water or steam, nitrogen, oxygen, argon, derivatives thereof, or mixtures thereof. In some embodiments, the heat source stream 110 may derive thermal energy from renewable sources of thermal energy, such as solar or geothermal sources.

Turning now to the power generation system 90, the illustrated embodiment includes the power turbine 228 disposed between a high pressure side and a low pressure side of the working fluid circuit 202. The power turbine 228 is configured to convert thermal energy to mechanical energy by a pressure drop in the working fluid flowing between the high and the low pressure sides of the working fluid circuit 202. A power generator 240 is coupled to the power turbine 228 and configured to convert the mechanical energy into electrical energy. In certain embodiments, a power outlet 242 may be electrically coupled to the power generator 240 and configured to transfer the electrical energy from the power generator 240 to an electrical grid 244. The illustrated power generation system 90 also contains a driveshaft 230 and a gearbox 232 coupled between the power turbine 228 and the power generator 240.

In one or more configurations, the power generation system 90 is disposed on or in the power generation skid 222 that contains inlets 225*a*, 225*b* and an outlet 227 fluidly coupled to and in thermal communication with the working fluid within the working fluid circuit 202. The inlets 225*a*, 225*b* are upstream to the power turbine 228 within the high pressure side of the working fluid circuit 202 and are configured to receive the heated and high pressure working fluid. In some examples, the inlet 225*a* may be fluidly coupled to the outlet 124 of the waste heat system 100 and configured to receive the working fluid flowing from the heat exchanger 120 and the inlet 225*b* may be fluidly coupled to the outlet 241 of the process system 210 and configured to receive the working fluid flowing from the turbopump 260 and/or the start pump 280. The outlet 227 is disposed downstream from the power turbine 228 within the low pressure side of the working fluid circuit 202 and is configured to provide the low pressure working fluid. In some examples, the outlet 227 may be fluidly coupled to the inlet 239 of the process system 210 and configured to flow the working fluid to the recuperator 216.

A filter 215*a* may be disposed along and in fluid communication with the fluid line at a point downstream from the heat exchanger 120 and upstream to the power turbine 228. In some examples, the filter 215*a* is fluidly coupled to the working fluid circuit 202 between the outlet 124 of the waste heat system 100 and the inlet 225*a* of the process system 210.

Again, the portion of the working fluid circuit 202 within the power generation system 90 is fed the working fluid by the inlets 225*a* and 225*b*. Additionally, a power turbine stop valve 217 is fluidly coupled to the working fluid circuit 202 between the inlet 225*a* and the power turbine 228. The power turbine stop valve 217 is configured to control the working fluid flowing from the heat exchanger 120, through the inlet 225*a*, and into the power turbine 228 while in an opened position. Alternatively, the power turbine stop valve 217 may be configured to cease the flow of working fluid from entering into the power turbine 228 while in a closed position.

A power turbine attemperator valve 223 is fluidly coupled to the working fluid circuit 202 via an attemperator bypass line 211 disposed between the outlet on the pump portion 262 of the turbopump 260 and the inlet on the power turbine 228 and/or disposed between the outlet on the pump portion 282 of the start pump 280 and the inlet on the power turbine 228. The attemperator bypass line 211 and the power turbine attemperator valve 223 may be configured to flow the working fluid from the pump portion 262 or 282, around and avoid the recuperator 216 and the heat exchangers 120 and 130, and to the power turbine 228, such as during a warm-up or cool-down step. The attemperator bypass line 211 and the power turbine attemperator valve 223 may be utilized to warm the working fluid with heat coming from the power turbine 228 while avoiding the thermal heat from the heat source stream 110 flowing through the heat exchangers, such as the heat exchangers 120 and 130. In some examples, the power turbine attemperator valve 223 may be fluidly coupled to the working fluid circuit 202 between the inlet 225*b* and the power turbine stop valve 217 upstream to a point on the fluid line that intersects the incoming stream from the inlet 225*a*. The power turbine attemperator valve 223 may be configured to control the working fluid flowing from the start pump 280 and/or the turbopump 260, through the inlet 225*b*, and to a power turbine stop valve 217, the power turbine bypass valve 219, and/or the power turbine 228.

The power turbine bypass valve 219 is fluidly coupled to a turbine bypass line that extends from a point of the working fluid circuit 202 upstream to the power turbine stop valve 217 and downstream from the power turbine 228. Therefore, the bypass line and the power turbine bypass valve 219 are configured to direct the working fluid around and avoid the power turbine 228. If the power turbine stop valve 217 is in a closed position, the power turbine bypass valve 219 may be configured to flow the working fluid around and avoid the power turbine 228 while in an opened position. In one embodiment, the power turbine bypass valve 219 may be utilized while warming up the working fluid during a startup operation of the electricity generating process. An outlet valve 221 is fluidly coupled to the working fluid circuit 202 between the outlet on the power turbine 228 and the outlet 227 of the power generation system 90.

Turning now to the process system 210, in one or more configurations, the process system 210 is disposed on or in the main process skid 212 and includes inlets 235, 239, and 255 and outlets 231, 237, 241, 251, and 253 fluidly coupled to and in thermal communication with the working fluid within the working fluid circuit 202. The inlet 235 is upstream to the recuperator 216 and the outlet 154 is downstream from the recuperator 216. The working fluid circuit 202 is configured to flow the working fluid from the inlet 235, through the recuperator 216, and to the outlet 237 while transferring thermal energy from the working fluid in the low pressure side of the working fluid circuit 202 to the working fluid in the high pressure side of the working fluid circuit 202 by the recuperator 216. The outlet 241 of the process system 210 is downstream from the turbopump 260 and/or the start pump 280, upstream to the power turbine 228, and configured to provide a flow of the high pressure working fluid to the power generation system 90, such as to the power turbine 228. The inlet 239 is upstream to the recuperator 216, downstream from the power turbine 228, and configured to receive the low pressure working fluid flowing from the power generation system 90, such as to the power turbine 228. The outlet 251 of the process system 210 is downstream from the recuperator 218, upstream to the heat exchanger 150, and configured to provide a flow of working fluid to the heat exchanger 150. The inlet 255 is downstream from the heat exchanger 150, upstream to the drive turbine 264 of the turbopump 260, and configured to provide the heated high pressure working fluid flowing from the heat exchanger 150 to the drive turbine 264 of the turbopump 260. The outlet 253 of the process system 210 is downstream from the pump portion 262 of the turbopump 260 and/or the pump portion 282 of the start pump 280, couples a bypass line disposed downstream from the heat exchanger 150 and upstream to the drive turbine 264 of the turbopump 260, and configured to provide a flow of working fluid to the drive turbine 264 of the turbopump 260.

Additionally, a filter 215*c* may be disposed along and in fluid communication with the fluid line at a point downstream from the heat exchanger 150 and upstream to the drive turbine 264 of the turbopump 260. In some examples, the filter 215*c* is fluidly coupled to the working fluid circuit 202 between the outlet 154 of the waste heat system 100 and the inlet 255 of the process system 210. Further, a filter 215*b* may be disposed along and in fluid communication with the fluid line 135 at a point downstream from the heat exchanger 130 and upstream to the recuperator 216. In some examples, the filter 215*b* is fluidly coupled to the working fluid circuit 202 between the outlet 134 of the waste heat system 100 and the inlet 235 of the process system 210.

In certain embodiments, as illustrated in FIG. 1, the process system 210 may be disposed on or in the main process skid 212, the power generation system 90 may be disposed on or in a power generation skid 222, and the waste heat system 100 may be disposed on or in a waste heat skid 102. In these embodiments, the working fluid circuit 202 extends throughout the inside, the outside, and between the main process skid 212, the power generation skid 222, and the waste heat skid 102, as well as other systems and portions of the heat engine system 90. Further, in some embodiments, the heat engine system 90 includes the heat exchanger bypass line 160 and the heat exchanger bypass valve 162 disposed between the waste heat skid 102 and the main process skid 212 for the purpose of routing the working fluid away from one or more of the heat exchangers during startup to reduce or eliminate component wear and/or damage, as described in more detail below.

Turning now to features of the working fluid circuit 202, the working fluid circuit 202 contains the working fluid (e.g., sc-$CO_2$) and has a high pressure side and a low pressure side. FIG. 1 depicts the high and low pressure sides of the working fluid circuit 202 of the heat engine system 90 by representing the high pressure side with "-" and the low pressure side with ""-----" "—as described in one or more embodiments. In certain embodiments, the working fluid circuit 202 includes one or more pumps, such as the illustrated turbopump 260 and start pump 280. The turbopump 260 and the start pump 280 are operative to pressurize and circulate the working fluid throughout the working fluid circuit 202.

The turbopump 260 may be a turbo-drive pump or a turbine-drive pump and has a pump portion 262 and a drive turbine 264 coupled together by a driveshaft 267 and an optional gearbox (not shown). The driveshaft 267 may be a single piece or may contain two or more pieces coupled together. In one example, a first segment of the driveshaft 267 extends from the drive turbine 264 to the gearbox, a second segment of the driveshaft 230 extends from the gearbox to the pump portion 262, and multiple gears are disposed between and couple to the two segments of the driveshaft 267 within the gearbox.

The drive turbine 264 is configured to rotate the pump portion 262 and the pump portion 262 is configured to circulate the working fluid within the working fluid circuit 202. Accordingly, the pump portion 262 of the turbopump 260 may be disposed between the high pressure side and the low pressure side of the working fluid circuit 202. The pump inlet on the pump portion 262 is generally disposed in the low pressure side and the pump outlet on the pump portion 262 is generally disposed in the high pressure side. The drive turbine 264 of the turbopump 260 may be fluidly coupled to the working fluid circuit 202 downstream from the heat exchanger 150, and the pump portion 262 of the turbopump 260 is fluidly coupled to the working fluid circuit 202 upstream to the heat exchanger 120 for providing the heated working fluid to the turbopump 260 to move or otherwise power the drive turbine 264.

The start pump 280 has a pump portion 282 and a motor-drive portion 284. The start pump 280 is generally an electric motorized pump or a mechanical motorized pump, and may be a variable frequency driven pump. During operation, once a predetermined pressure, temperature, and/or flowrate of the working fluid is obtained within the working fluid circuit 202, the start pump 280 may be taken off line, idled, or turned off, and the turbopump 260 may be utilized to circulate the working fluid during the electricity generation process. The working fluid enters each of the turbopump 260 and the start pump 280 from the low pressure side of the working fluid circuit 202 and exits each of the turbopump 260 and the start pump 280 from the high pressure side of the working fluid circuit 202.

The start pump 280 may be a motorized pump, such as an electric motorized pump, a mechanical motorized pump, or other type of pump. Generally, the start pump 280 may be a variable frequency motorized drive pump and contains a pump portion 282 and a motor-drive portion 284. The motor-drive portion 284 of the start pump 280 contains a motor and a drive including a driveshaft and gears. In some examples, the motor-drive portion 284 has a variable frequency drive, such that the speed of the motor may be regulated by the drive. The pump portion 282 of the start pump 280 is driven by the motor-drive portion 284 coupled thereto. The pump portion 282 has an inlet for receiving the working fluid from the low pressure side of the working fluid circuit 202, such as from the condenser 274 and/or the working fluid storage system 290. The pump portion 282 has an outlet for releasing the working fluid into the high pressure side of the working fluid circuit 202.

Start pump inlet valve 283 and start pump outlet valve 285 may be utilized to control the flow of the working fluid passing through the start pump 180. Start pump inlet valve 283 may be fluidly coupled to the low pressure side of the working fluid circuit 202 upstream to the pump portion 282 of the start pump 280 and may be utilized to control the flowrate of the working fluid entering the inlet of the pump portion 282. Start pump outlet valve 285 may be fluidly coupled to the high pressure side of the working fluid circuit 202 downstream from the pump portion 282 of the start pump 280 and may be utilized to control the flowrate of the working fluid exiting the outlet of the pump portion 282.

The drive turbine 264 of the turbopump 260 is driven by heated working fluid, such as the working fluid flowing from the heat exchanger 150. The drive turbine 264 is fluidly coupled to the high pressure side of the working fluid circuit 202 by an inlet configured to receive the working fluid from the high pressure side of the working fluid circuit 202, such as flowing from the heat exchanger 150. The drive turbine 264 is fluidly coupled to the low pressure side of the working fluid circuit 202 by an outlet configured to release the working fluid into the low pressure side of the working fluid circuit 202.

The pump portion 262 of the turbopump 260 is driven by the driveshaft 267 coupled to the drive turbine 264. The pump portion 262 of the turbopump 260 may be fluidly coupled to the low pressure side of the working fluid circuit 202 by an inlet configured to receive the working fluid from the low pressure side of the working fluid circuit 202. The inlet of the pump portion 262 is configured to receive the working fluid from the low pressure side of the working fluid circuit 202, such as from the condenser 274 and/or the working fluid storage system 290. Also, the pump portion 262 may be fluidly coupled to the high pressure side of the working fluid circuit 202 by an outlet configured to release the working fluid into the high pressure side of the working fluid circuit 202 and circulate the working fluid within the working fluid circuit 202.

In one configuration, the working fluid released from the outlet on the drive turbine 264 is returned into the working fluid circuit 202 downstream from the recuperator 216 and upstream to the recuperator 218. In one or more embodiments, the turbopump 260, including piping and valves, is optionally disposed on a turbo pump skid 266, as depicted in FIG. 2. The turbo pump skid 266 may be disposed on or adjacent to the main process skid 212.

A drive turbine bypass valve 265 is generally coupled between and in fluid communication with a fluid line extending from the inlet on the drive turbine 264 with a fluid line extending from the outlet on the drive turbine 264. The drive turbine bypass valve 265 is generally opened to bypass the turbopump 260 while using the start pump 280 during the initial stages of generating electricity with the heat engine system 90. Once a predetermined pressure and temperature of the working fluid is obtained within the working fluid circuit 202, the drive turbine bypass valve 265 is closed and the heated working fluid is flowed through the drive turbine 264 to start the turbopump 260.

A drive turbine throttle valve 263 may be coupled between and in fluid communication with a fluid line extending from the heat exchanger 150 to the inlet on the drive turbine 264 of the turbopump 260. The drive turbine throttle valve 263 is configured to modulate the flow of the heated working fluid into the drive turbine 264, which in turn may be utilized to adjust the flow of the working fluid throughout the working fluid circuit 202. Additionally, valve 293 may be utilized to provide back pressure for the drive turbine 264 of the turbopump 260.

A drive turbine attemperator valve 295 may be fluidly coupled to the working fluid circuit 202 via an attemperator bypass line 291 disposed between the outlet on the pump portion 262 of the turbopump 260 and the inlet on the drive turbine 264 and/or disposed between the outlet on the pump portion 282 of the start pump 280 and the inlet on the drive turbine 264. The attemperator bypass line 291 and the drive turbine attemperator valve 295 may be configured to flow the working fluid from the pump portion 262 or 282, around the recuperator 218 and the heat exchanger 150 to avoid such components, and to the drive turbine 264, such as during a warm-up or cool-down step of the turbopump 260. The attemperator bypass line 291 and the drive turbine attemperator valve 295 may be utilized to warm the working fluid with the drive turbine 264 while avoiding the thermal heat from the heat source stream 110 via the heat exchangers, such as the heat exchanger 150.

In another embodiment, the heat engine system 200 depicted in FIG. 1 has two pairs of turbine attemperator lines and valves, such that each pair of attemperator line and valve is fluidly coupled to the working fluid circuit 202 and disposed upstream to a respective turbine inlet, such as a drive turbine inlet and a power turbine inlet. The power turbine attemperator line 211 and the power turbine attemperator valve 223 are fluidly coupled to the working fluid circuit 202 and disposed upstream to a turbine inlet on the power turbine 264. Similarly, the drive turbine attemperator line 291 and the drive turbine attemperator valve 295 are fluidly coupled to the working fluid circuit 202 and disposed upstream to a turbine inlet on the turbopump 260.

The power turbine attemperator valve 223 and the drive turbine attemperator valve 295 may be utilized during a startup and/or shutdown procedure of the heat engine system 200 to control backpressure within the working fluid circuit 202. Also, the power turbine attemperator valve 223 and the drive turbine attemperator valve 295 may be utilized during a startup and/or shutdown procedure of the heat engine system 200 to cool hot flow of the working fluid from heat saturated heat exchangers, such as heat exchangers 120, 130, 140, and/or 150, coupled to and in thermal communication with working fluid circuit 202. The power turbine attemperator valve 223 may be modulated, adjusted, or otherwise controlled to manage the inlet temperature $T_1$ and/or the inlet pressure at (or upstream from) the inlet of the power turbine 228, and to cool the heated working fluid flowing from the outlet of the heat exchanger 120. Similarly, the drive turbine attemperator valve 295 may be modulated, adjusted, or otherwise controlled to manage the inlet temperature and/or the inlet pressure at (or upstream from) the inlet of the drive turbine 264, and to cool the heated working fluid flowing from the outlet of the heat exchanger 150.

In some embodiments, the drive turbine attemperator valve 295 may be modulated, adjusted, or otherwise controlled with the process control system 204 to decrease the inlet temperature of the drive turbine 264 by increasing the flowrate of the working fluid passing through the attemperator bypass line 291 and the drive turbine attemperator valve 295 and detecting a desirable value of the inlet temperature of the drive turbine 264 via the process control system 204. The desirable value is generally at or less than the predetermined threshold value of the inlet temperature of the drive turbine 264. In some examples, such as during startup of the turbopump 260, the desirable value for the inlet temperature upstream to the drive turbine 264 may be about 150° C. or less. In other examples, such as during an energy conversion process, the desirable value for the inlet temperature upstream to the drive turbine 264 may be about 170° C. or less, such as about 168° C. or less. The drive turbine 264 and/or components therein may be damaged if the inlet temperature is about 168° C. or greater.

In some embodiments, the working fluid may flow through the attemperator bypass line 291 and the drive turbine attemperator valve 295 to bypass the heat exchanger 150. This flow of the working fluid may be adjusted with throttle valve 263 to control the inlet temperature of the drive turbine 264. During the startup of the turbopump 260, the desirable value for the inlet temperature upstream to the drive turbine 264 may be about 150° C. or less. As power is increased, the inlet temperature upstream to the drive turbine 264 may be raised to optimize cycle efficiency and operability by reducing the flow through the attemperator bypass line 291. At full power, the inlet temperature upstream to the drive turbine 264 may be about 340° C. or greater and the flow of the working fluid bypassing the heat exchanger 150 through the attemperator bypass line 291 ceases, such as approaches about 0 kg/s, in some examples. Also, the pressure may range from about 14 MPa to about 23.4 MPa as the flow of the working fluid may be within a range from about 0 kg/s to about 32 kg/s depending on power level.

A control valve 261 may be disposed downstream from the outlet of the pump portion 262 of the turbopump 260 and the control valve 281 may be disposed downstream from the outlet of the pump portion 282 of the start pump 280. Control valves 261 and 281 are flow control safety valves and generally utilized to regulate the directional flow or to prohibit backflow of the working fluid within the working fluid circuit 202. Control valve 261 is configured to prevent the working fluid from flowing upstream towards or into the outlet of the pump portion 262 of the turbopump 260. Similarly, control valve 281 is configured to prevent the working fluid from flowing upstream towards or into the outlet of the pump portion 282 of the start pump 280.

The drive turbine throttle valve 263 is fluidly coupled to the working fluid circuit 202 upstream to the inlet of the drive turbine 264 of the turbopump 260 and configured to control a flow of the working fluid flowing into the drive turbine 264. The power turbine bypass valve 219 is fluidly coupled to the power turbine bypass line 208 and configured to modulate, adjust, or otherwise control the working fluid flowing through the power turbine bypass line 208 for controlling the flowrate of the working fluid entering the power turbine 228.

The power turbine bypass line 208 is fluidly coupled to the working fluid circuit 202 at a point upstream to an inlet of the power turbine 228 and at a point downstream from an outlet of the power turbine 228. The power turbine bypass line 208 is configured to flow the working fluid around and avoid the power turbine 228 when the power turbine bypass valve 219 is in an opened position. The flowrate and the pressure of the working fluid flowing into the power turbine 228 may be reduced or stopped by adjusting the power turbine bypass valve 219 to the opened position. Alternatively, the flowrate and the pressure of the working fluid flowing into the power turbine 228 may be increased or started by adjusting the power turbine bypass valve 219 to the closed position due to the backpressure formed through the power turbine bypass line 208.

The power turbine bypass valve 219 and the drive turbine throttle valve 263 may be independently controlled by the process control system 204 that is communicably connected, wired and/or wirelessly, with the power turbine bypass valve 219, the drive turbine throttle valve 263, and other parts of the heat engine system 90. The process control system 204 is operatively connected to the working fluid circuit 202 and a mass management system 270 and is enabled to monitor and control multiple process operation parameters of the heat engine system 90.

In one or more embodiments, the working fluid circuit 202 provides a bypass flowpath for the start pump 280 via the start pump bypass line 224 and a start pump bypass valve 254, as well as a bypass flowpath for the turbopump 260 via the turbo pump bypass line 226 and a turbo pump bypass valve 256. One end of the start pump bypass line 224 is fluidly coupled to an outlet of the pump portion 282 of the start pump 280 and the other end of the start pump bypass line 224 is fluidly coupled to a fluid line 229. Similarly, one end of a turbo pump bypass line 226 is fluidly coupled to an outlet of the pump portion 262 of the turbopump 260 and the other end of the turbo pump bypass line 226 is coupled to the start pump bypass line 224. In some configurations, the start pump bypass line 224 and the turbo pump bypass line 226 merge together as a single line upstream of coupling to a fluid line 229. The fluid line 229 extends between and is fluidly coupled to the recuperator 218 and the condenser 274. The start pump bypass valve 254 is disposed along the start pump bypass line 224 and fluidly coupled between the low pressure side and the high pressure side of the working fluid circuit 202 when in a closed position. Similarly, the turbo pump bypass valve 256 is disposed along the turbo pump bypass line 226 and fluidly coupled between the low pressure side and the high pressure side of the working fluid circuit 202 when in a closed position.

FIG. 1 further depicts a power turbine throttle valve 250 fluidly coupled to a bypass line 246 on the high pressure side of the working fluid circuit 202 and upstream to the heat exchanger 120, as disclosed by at least one embodiment described herein. The power turbine throttle valve 250 is fluidly coupled to the bypass line 246 and configured to modulate, adjust, or otherwise control the working fluid flowing through the bypass line 246 for controlling a general coarse flowrate of the working fluid within the working fluid circuit 202. The bypass line 246 is fluidly coupled to the working fluid circuit 202 at a point upstream to the valve 293 and at a point downstream from the pump portion 282 of the start pump 280 and/or the pump portion 262 of the turbopump 260. Additionally, a power turbine trim valve 252 is fluidly coupled to a bypass line 248 on the high pressure side of the working fluid circuit 202 and upstream to the heat exchanger 150, as disclosed by another embodiment described herein. The power turbine trim valve 252 is fluidly coupled to the bypass line 248 and configured to modulate, adjust, or otherwise control the working fluid flowing through the bypass line 248 for controlling a fine flowrate of the working fluid within the working fluid circuit 202. The bypass line 248 is fluidly coupled to the bypass line 246 at a point upstream to the power turbine throttle valve 250 and at a point downstream from the power turbine throttle valve 250.

The heat engine system 90 further contains a drive turbine throttle valve 263 fluidly coupled to the working fluid circuit 202 upstream to the inlet of the drive turbine 264 of the turbopump 260 and configured to modulate a flow of the working fluid flowing into the drive turbine 264, a power turbine bypass line 208 fluidly coupled to the working fluid circuit 202 upstream to an inlet of the power turbine 228, fluidly coupled to the working fluid circuit 202 downstream from an outlet of the power turbine 228, and configured to flow the working fluid around and avoid the power turbine 228, a power turbine bypass valve 219 fluidly coupled to the power turbine bypass line 208 and configured to modulate a flow of the working fluid flowing through the power turbine bypass line 208 for controlling the flowrate of the working fluid entering the power turbine 228, and the process control system 204 operatively connected to the heat engine system 90, wherein the process control system 204 is configured to adjust the drive turbine throttle valve 263 and the power turbine bypass valve 219.

A heat exchanger bypass line 160 is fluidly coupled to a fluid line 131 of the working fluid circuit 202 upstream to the heat exchangers 120, 130, and/or 150 by a heat exchanger bypass valve 162, as illustrated in FIG. 1 and described in more detail below. The heat exchanger bypass valve 162 may be a solenoid valve, a hydraulic valve, an electric valve, a manual valve, or derivatives thereof. In many examples, the heat exchanger bypass valve 162 is a solenoid valve and configured to be controlled by the process control system 204. Regardless of the valve type, however, the valve may be controlled to route the working fluid in a manner that maintains the temperature of the working fluid at a level appropriate for the current operational state of the heat engine system. For example, the bypass valve may be regulated during startup to control the flow of the working fluid through a reduced quantity of heat exchangers to effectuate a lower working fluid temperature than would be achieved during a fully operational state when the working fluid is routed through all the heat exchangers.

In one or more embodiments, the working fluid circuit 202 provides release valves 213*a*, 213*b*, 213*c*, and 213*d*, as well as release outlets 214*a*, 214*b*, 214*c*, and 214*d*, respectively in fluid communication with each other. Generally, the release valves 213*a*, 213*b*, 213*c*, and 213*d* remain closed during the electricity generation process, but may be configured to automatically open to release an over-pressure at a predetermined value within the working fluid. Once the working fluid flows through the valve 213*a*, 213*b*, 213*c*, or 213*d*, the working fluid is vented through the respective release outlet 214*a*, 214*b*, 214*c*, or 214*d*. The release outlets 214*a*, 214*b*, 214*c*, and 214*d* may provide passage of the working fluid into the ambient surrounding atmosphere. Alternatively, the release outlets 214*a*, 214*b*, 214*c*, and 214*d* may provide passage of the working fluid into a recycling or reclamation step that generally includes capturing, condensing, and storing the working fluid.

The release valve 213*a* and the release outlet 214*a* are fluidly coupled to the working fluid circuit 202 at a point disposed between the heat exchanger 120 and the power turbine 228. The release valve 213*b* and the release outlet 214*b* are fluidly coupled to the working fluid circuit 202 at a point disposed between the heat exchanger 150 and the drive turbine 264 of the turbopump 260. The release valve 213*c* and the release outlet 214*c* are fluidly coupled to the working fluid circuit 202 via a bypass line that extends from a point between the valve 293 and the pump portion 262 of the turbopump 260 to a point on the turbo pump bypass line 226 between the turbo pump bypass valve 256 and the fluid line 229. The release valve 213*d* and the release outlet 214*d* are fluidly coupled to the working fluid circuit 202 at a point disposed between the recuperator 218 and the condenser 274.

A computer system 206, as part of the process control system 204, contains a multi-controller algorithm utilized to control the drive turbine throttle valve 263, the power turbine bypass valve 219, the heat exchanger bypass valve 162, the power turbine throttle valve 250, the power turbine trim valve 252, as well as other valves, pumps, and sensors within the heat engine system 90. In one embodiment, the process control system 204 is enabled to move, adjust, manipulate, or otherwise control the heat exchanger bypass valve 162, the power turbine throttle valve 250, and/or the power turbine trim valve 252 for adjusting or controlling the flow of the working fluid throughout the working fluid circuit 202. By controlling the flow of the working fluid, the process control system 204 is also operable to regulate the temperatures and pressures throughout the working fluid circuit 202. For example, the control system 204 may regulate the temperature of the working fluid during startup by controlling the position of the bypass valve 162 to reduce or eliminate damage to one or more downstream components due to overheated working fluid.

In some embodiments, the process control system 204 is communicably connected, wired and/or wirelessly, with numerous sets of sensors, valves, and pumps, in order to process the measured and reported temperatures, pressures, and mass flowrates of the working fluid at the designated points within the working fluid circuit 202. In response to these measured and/or reported parameters, the process control system 204 may be operable to selectively adjust the valves in accordance with a control program or algorithm, thereby maximizing operation of the heat engine system 90.

Further, in certain embodiments, the process control system 204, as well as any other controllers or processors disclosed herein, may include one or more non-transitory, tangible, machine-readable media, such as read-only memory (ROM), random access memory (RAM), solid state memory (e.g., flash memory), floppy diskettes, CD-ROMs, hard drives, universal serial bus (USB) drives, any other computer readable storage medium, or any combination thereof. The storage media may store encoded instructions, such as firmware, that may be executed by the process control system 204 to operate the logic or portions of the logic presented in the methods disclosed herein. For example, in certain embodiments, the heat engine system 90 may include computer code disposed on a computer-readable storage medium or a process controller that includes such a computer-readable storage medium. The computer code may include instructions for initiating a control function to alternate the position of the bypass valve 162 during startup to route the working fluid around one or more heat exchangers, or during a fully operational mode to route the working fluid through one or more heat exchangers.

In some embodiments, the process control system 204 contains a control algorithm embedded in a computer system 206 and the control algorithm contains a governing loop controller. The governing controller is generally utilized to adjust values throughout the working fluid circuit 202 for controlling the temperature, pressure, flowrate, and/or mass of the working fluid at specified points therein. In some embodiments, the governing loop controller may be configured to maintain desirable threshold values for the inlet temperature and the inlet pressure by modulating, adjusting, or otherwise controlling the drive turbine attemperator valve 295 and the drive turbine throttle valve 263. In other embodiments, the governing loop controller may be configured to maintain desirable threshold values for the inlet temperature by modulating, adjusting, or otherwise controlling the power turbine attemperator valve 223 and the power turbine throttle valve 250.

The process control system 204 may operate with the heat engine system 90 semi-passively with the aid of several sets of sensors. The first set of sensors is arranged at or adjacent the suction inlet of the turbopump 260 and the start pump 280 and the second set of sensors is arranged at or adjacent the outlet of the turbopump 260 and the start pump 280. The first and second sets of sensors monitor and report the pressure, temperature, mass flowrate, or other properties of the working fluid within the low and high pressure sides of the working fluid circuit 202 adjacent the turbopump 260 and the start pump 280. The third set of sensors is arranged either inside or adjacent the working fluid storage vessel 292 of the working fluid storage system 290 to measure and report the pressure, temperature, mass flowrate, or other properties of the working fluid within the working fluid storage vessel 292. Additionally, an instrument air supply (not shown) may be coupled to sensors, devices, or other instruments within the heat engine system 90 including the mass management system 270 and/or other system components that may utilize a gaseous supply, such as nitrogen or air.

In some embodiments, the overall efficiency of the heat engine system 90 and the amount of power ultimately generated can be influenced by the inlet or suction pressure at the pump when the working fluid contains supercritical carbon dioxide. In order to minimize or otherwise regulate the suction pressure of the pump, the heat engine system 90 may incorporate the use of a mass management system ("MMS") 270. The mass management system 270 controls the inlet pressure of the start pump 280 by regulating the amount of working fluid entering and/or exiting the heat engine system 90 at strategic locations in the working fluid circuit 202, such as at tie-in points, inlets/outlets, valves, or conduits throughout the heat engine system 90. Consequently, the heat engine system 90 becomes more efficient by increasing the pressure ratio for the start pump 280 to a maximum possible extent.

The mass management system 270 contains at least one vessel or tank, such as a storage vessel (e.g., working fluid storage vessel 292), a fill vessel, and/or a mass control tank (e.g., mass control tank 286), fluidly coupled to the low pressure side of the working fluid circuit 202 via one or more valves, such as valve 287. The valves are moveable—as being partially opened, fully opened, and/or closed—to either remove working fluid from the working fluid circuit 202 or add working fluid to the working fluid circuit 202. Exemplary embodiments of the mass management system 270, and a range of variations thereof, are found in U.S. application Ser. No. 13/278,705, filed Oct. 21, 2011, and published as U.S. Pub. No. 2012-0047892, the contents of which are incorporated herein by reference to the extent consistent with the present disclosure. Briefly, however, the mass management system 270 may include a plurality of valves and/or connection points, each in fluid communication with the mass control tank 286. The valves may be characterized as termination points where the mass management system 270 is operatively connected to the heat engine system 90. The connection points and valves may be configured to provide the mass management system 270 with an outlet for flaring excess working fluid or pressure, or to provide the mass management system 270 with additional/supplemental working fluid from an external source, such as a fluid fill system.

In some embodiments, the mass control tank 286 may be configured as a localized storage tank for additional/supplemental working fluid that may be added to the heat engine system 90 when needed in order to regulate the pressure or temperature of the working fluid within the working fluid circuit 202 or otherwise supplement escaped working fluid. By controlling the valves, the mass management system 270 adds and/or removes working fluid mass to/from the heat engine system 90 with or without the need of a pump, thereby reducing system cost, complexity, and maintenance.

In some examples, a working fluid storage vessel 292 is part of a working fluid storage system 290 and is fluidly coupled to the working fluid circuit 202. At least one connection point, such as a working fluid feed 288, may be a fluid fill port for the working fluid storage vessel 292 of the working fluid storage system 290 and/or the mass management system 270. Additional or supplemental working fluid may be added to the mass management system 270 from an external source, such as a fluid fill system via the working fluid feed 288. Exemplary fluid fill systems are described and illustrated in U.S. Pat. No. 8,281,593, the contents of which are incorporated herein by reference to the extent consistent with the present disclosure.

In another embodiment described herein, bearing gas and seal gas may be supplied to the turbopump 260 or other devices contained within and/or utilized along with the heat engine system 90. One or multiple streams of bearing gas and/or seal gas may be derived from the working fluid within the working fluid circuit 202 and contain carbon dioxide in a gaseous, subcritical, or supercritical state.

In some examples, the bearing gas or fluid is flowed by the start pump 280, from a bearing gas supply **296*a* and/or a bearing gas supply 296*b*, into the working fluid circuit 202, through a bearing gas supply line (not shown), and to the bearings within the power generation system 90. In other examples, the bearing gas or fluid is flowed by the start pump 280, from the bearing gas supply 296*a* and/or the bearing gas supply 296*b*, from the working fluid circuit 202, through a bearing gas supply line (not shown), and to the bearings within the turbopump 260. The gas return 298** may be a connection point or valve that feeds into a gas system, such as a bearing gas, dry gas, seal gas, or other system.

At least one gas return 294 is generally coupled to a discharge, recapture, or return of bearing gas, seal gas, and other gases. The gas return 294 provides a feed stream into the working fluid circuit 202 of recycled, recaptured, or otherwise returned gases—generally derived from the working fluid. The gas return 294 is generally fluidly coupled to the working fluid circuit 202 upstream to the condenser 274 and downstream from the recuperator 218.

In another embodiment, the bearing gas supply source 141 is fluidly coupled to the bearing housing 268 of the turbopump 260 by the bearing gas supply line 142. The flow of the bearing gas or other gas into the bearing housing 268 may be controlled via the bearing gas supply valve 144 that is operatively coupled to the bearing gas supply line 142 and controlled by the process control system 204. The bearing gas or other gas generally flows from the bearing gas supply source 141, through the bearing housing 268 of the turbopump 260, and to the bearing gas recapture 148. The bearing gas recapture 148 is fluidly coupled to the bearing housing 268 by the bearing gas recapture line 146. The flow of the bearing gas or other gas from the bearing housing 268 and to bearing gas recapture 148 may be controlled via the bearing gas recapture valve 147 that is operatively coupled to the bearing gas recapture line 146 and controlled by the process control system 204.

In one or more embodiments, a working fluid storage vessel 292 may be fluidly coupled to the start pump 280 via the working fluid circuit 202 within the heat engine system 90. The working fluid storage vessel 292 and the working fluid circuit 202 contain the working fluid (e.g., carbon dioxide) and the working fluid circuit 202 fluidly has a high pressure side and a low pressure side.

The heat engine system 90 further contains a bearing housing, case, or other chamber, such as the bearing housings 238 and 268, fluidly coupled to and/or substantially encompassing or enclosing bearings within power generation system 90 and the turbine pump 260, respectively. In one embodiment, the turbopump 260 contains the drive turbine 264, the pump portion 262, and the bearing housing 268 fluidly coupled to and/or substantially encompassing or enclosing the bearings. The turbopump 260 further may contain a gearbox and/or a driveshaft 267 coupled between the drive turbine 264 and the pump portion 262. In another embodiment, the power generation system 90 contains the power turbine 228, the power generator 240, and the bearing housing 238 substantially encompassing or enclosing the bearings. The power generation system 90 further contains a gearbox 232 and a driveshaft 230 coupled between the power turbine 228 and the power generator 240.

Exemplary structures of the bearing housing 238 or 268 may completely or substantially encompass or enclose the bearings as well as all or part of turbines, generators, pumps, driveshafts, gearboxes, or other components shown or not shown for heat engine system 90. The bearing housing 238 or 268 may completely or partially include structures, chambers, cases, housings, such as turbine housings, generator housings, driveshaft housings, driveshafts that contain bearings, gearbox housings, derivatives thereof, or combinations thereof. FIGS. 1 and 2 depict the bearing housing 268 fluidly coupled to and/or containing all or a portion of the drive turbine 264, the pump portion 262, and the driveshaft 267 of the turbopump 260. In other examples, the housing of the drive turbine 264 and the housing of the pump portion 262 may be independently coupled to and/or form portions of the bearing housing 268. Similarly, the bearing housing 238 may be fluidly coupled to and/or contain all or a portion of the power turbine 228, the power generator 240, the driveshaft 230, and the gearbox 232 of the power generation system 90. In some examples, the housing of the power turbine 228 is coupled to and/or forms a portion of the bearing housing 238.

In one or more embodiments disclosed herein, the heat engine system 90 depicted in FIGS. 1 and 2 is configured to monitor and maintain the working fluid within the low pressure side of the working fluid circuit 202 in a supercritical state during a startup procedure. The working fluid may be maintained in a supercritical state by adjusting or otherwise controlling a pump suction pressure upstream to an inlet on the pump portion 262 of the turbopump 260 via the process control system 204 operatively connected to the working fluid circuit 202.

The process control system 204 may be utilized to maintain, adjust, or otherwise control the pump suction pressure at or greater than the critical pressure of the working fluid during the startup procedure. The working fluid may be kept in a liquid-type or supercritical state and free or substantially free the gaseous state within the low pressure side of the working fluid circuit 202. Therefore, the pump system, including the turbopump 260 and/or the start pump 280, may avoid pump cavitation within the respective pump portions 262 and 282.

In some embodiments, the types of working fluid that may be circulated, flowed, or otherwise utilized in the working fluid circuit 202 of the heat engine system 90 include carbon oxides, hydrocarbons, alcohols, ketones, halogenated hydrocarbons, ammonia, amines, aqueous, or combinations thereof. Exemplary working fluids used in the heat engine system 90 include carbon dioxide, ammonia, methane, ethane, propane, butane, ethylene, propylene, butylene, acetylene, methanol, ethanol, acetone, methyl ethyl ketone, water, derivatives thereof, or mixtures thereof. Halogenated hydrocarbons may include hydrochlorofluorocarbons (HCFCs), hydrofluorocarbons (HFCs) (e.g., 1,1,1,3,3-pentafluoropropane (R245fa)), fluorocarbons, derivatives thereof, or mixtures thereof.

In many embodiments described herein, the working fluid circulated, flowed, or otherwise utilized in the working fluid circuit 202 of the heat engine system 90, and the other exemplary circuits disclosed herein, may be or may contain carbon dioxide ($CO_2$) and mixtures containing carbon dioxide. Generally, at least a portion of the working fluid circuit 202 contains the working fluid in a supercritical state (e.g., sc-$CO_2$). Carbon dioxide utilized as the working fluid or contained in the working fluid for power generation cycles has many advantages over other compounds typical used as working fluids, since carbon dioxide has the properties of being non-toxic and non-flammable and is also easily available and relatively inexpensive. Due in part to a relatively high working pressure of carbon dioxide, a carbon dioxide system may be much more compact than systems using other working fluids. The high density and volumetric heat capacity of carbon dioxide with respect to other working fluids makes carbon dioxide more "energy dense" meaning that the size of all system components can be considerably reduced without losing performance. It should be noted that use of the terms carbon dioxide ($CO_2$), supercritical carbon dioxide (sc-$CO_2$), or subcritical carbon dioxide (sub-$CO_2$) is not intended to be limited to carbon dioxide of any particular type, source, purity, or grade. For example, industrial grade carbon dioxide may be contained in and/or used as the working fluid without departing from the scope of the disclosure.

In other exemplary embodiments, the working fluid in the working fluid circuit 202 may be a binary, ternary, or other working fluid blend. The working fluid blend or combination can be selected for the unique attributes possessed by the fluid combination within a heat recovery system, as described herein. For example, one such fluid combination includes a liquid absorbent and carbon dioxide mixture enabling the combined fluid to be pumped in a liquid state to high pressure with less energy input than required to compress carbon dioxide. In another exemplary embodiment, the working fluid may be a combination of supercritical carbon dioxide (sc-$CO_2$), subcritical carbon dioxide (sub-$CO_2$), and/or one or more other miscible fluids or chemical compounds. In yet other exemplary embodiments, the working fluid may be a combination of carbon dioxide and propane, or carbon dioxide and ammonia, without departing from the scope of the disclosure.

The working fluid circuit 202 generally has a high pressure side, a low pressure side, and a working fluid circulated within the working fluid circuit 202. The use of the term "working fluid" is not intended to limit the state or phase of matter of the working fluid. For instance, the working fluid or portions of the working fluid may be in a fluid phase, a gas phase, a supercritical state, a subcritical state, or any other phase or state at any one or more points within the heat engine system 90 or thermodynamic cycle. In one or more embodiments, the working fluid is in a supercritical state over certain portions of the working fluid circuit 202 of the heat engine system 90 (e.g., a high pressure side) and in a subcritical state over other portions of the working fluid circuit 202 of the heat engine system 90 (e.g., a low pressure side).

In other embodiments, the entire thermodynamic cycle may be operated such that the working fluid is maintained in either a supercritical or subcritical state throughout the entire working fluid circuit 202 of the heat engine system 90. During different stages of operation, the high and low pressure sides the working fluid circuit 202 for the heat engine system 90 may contain the working fluid in a supercritical and/or subcritical state. For example, the high and low pressure sides of the working fluid circuit 202 may both contain the working fluid in a supercritical state during the startup procedure. However, once the system is synchronizing, load ramping, and/or fully loaded, the high pressure side of the working fluid circuit 202 may keep the working fluid in a supercritical state while the low pressure side the working fluid circuit 202 may be adjusted to contain the working fluid in a subcritical state or other liquid-type state.

Generally, the high pressure side of the working fluid circuit 202 contains the working fluid (e.g., sc-$CO_2$) at a pressure of about 15 MPa or greater, such as about 17 MPa or greater or about 20 MPa or greater. In some examples, the high pressure side of the working fluid circuit 202 may have a pressure within a range from about 15 MPa to about 30 MPa, more narrowly within a range from about 16 MPa to about 26 MPa, more narrowly within a range from about 17 MPa to about 25 MPa, and more narrowly within a range from about 17 MPa to about 24 MPa, such as about 23.3 MPa. In other examples, the high pressure side of the working fluid circuit 202 may have a pressure within a range from about 20 MPa to about 30 MPa, more narrowly within a range from about 21 MPa to about 25 MPa, and more narrowly within a range from about 22 MPa to about 24 MPa, such as about 23 MPa.

The low pressure side of the working fluid circuit 202 contains the working fluid (e.g., $CO_2$ or sub-$CO_2$) at a pressure of less than 15 MPa, such as about 12 MPa or less, or about 10 MPa or less. In some examples, the low pressure side of the working fluid circuit 202 may have a pressure within a range from about 4 MPa to about 14 MPa, more narrowly within a range from about 6 MPa to about 13 MPa, more narrowly within a range from about 8 MPa to about 12 MPa, and more narrowly within a range from about 10 MPa to about 11 MPa, such as about 10.3 MPa. In other examples, the low pressure side of the working fluid circuit 202 may have a pressure within a range from about 2 MPa to about 10 MPa, more narrowly within a range from about 4 MPa to about 8 MPa, and more narrowly within a range from about 5 MPa to about 7 MPa, such as about 6 MPa.

In some examples, the high pressure side of the working fluid circuit 202 may have a pressure within a range from about 17 MPa to about 23.5 MPa, and more narrowly within a range from about 23 MPa to about 23.3 MPa, while the low pressure side of the working fluid circuit 202 may have a pressure within a range from about 8 MPa to about 11 MPa, and more narrowly within a range from about 10.3 MPa to about 11 MPa.

Referring generally to FIG. 2, the heat engine system 90 includes the power turbine 228 disposed between the high pressure side and the low pressure side of the working fluid circuit 202, disposed downstream from the heat exchanger 120, and fluidly coupled to and in thermal communication with the working fluid. The power turbine 228 is configured to convert a pressure drop in the working fluid to mechanical energy whereby the absorbed thermal energy of the working fluid is transformed to mechanical energy of the power turbine 228. Therefore, the power turbine 228 is an expansion device capable of transforming a pressurized fluid into mechanical energy, generally, transforming high temperature and pressure fluid into mechanical energy, such as rotating a shaft (e.g., the driveshaft 230).

The power turbine 228 may contain or be a turbine, a turbo, an expander, or another device for receiving and expanding the working fluid discharged from the heat exchanger 120. The power turbine 228 may have an axial construction or radial construction and may be a single-staged device or a multi-staged device. Exemplary turbine devices that may be utilized in power turbine 228 include an expansion device, a geroler, a gerotor, a valve, other types of positive displacement devices such as a pressure swing, a turbine, a turbo, or any other device capable of transforming a pressure or pressure/enthalpy drop in a working fluid into mechanical energy. A variety of expanding devices are capable of working within the inventive system and achieving different performance properties that may be utilized as the power turbine 228.

The power turbine 228 is generally coupled to the power generator 240 by the driveshaft 230. A gearbox 232 is generally disposed between the power turbine 228 and the power generator 240 and adjacent or encompassing the driveshaft 230. The driveshaft 230 may be a single piece or may contain two or more pieces coupled together. In one example, as depicted in FIG. 2, a first segment of the driveshaft 230 extends from the power turbine 228 to the gearbox 232, a second segment of the driveshaft 230 extends from the gearbox 232 to the power generator 240, and multiple gears are disposed between and couple to the two segments of the driveshaft 230 within the gearbox 232.

In some configurations, the heat engine system 90 also provides for the delivery of a portion of the working fluid, seal gas, bearing gas, air, or other gas into a chamber or housing, such as a housing 238 within the power generation system 90 for purposes of cooling one or more parts of the power turbine 228. In other configurations, the driveshaft 230 includes a seal assembly (not shown) designed to prevent or capture any working fluid leakage from the power turbine 228. Additionally, a working fluid recycle system may be implemented along with the seal assembly to recycle seal gas back into the working fluid circuit 202 of the heat engine system 90.

The power generator 240 may be a generator, an alternator (e.g., permanent magnet alternator), or other device for generating electrical energy, such as transforming mechanical energy from the driveshaft 230 and the power turbine 228 to electrical energy. A power outlet 242 may be electrically coupled to the power generator 240 and configured to transfer the generated electrical energy from the power generator 240 and to an electrical grid 244. The electrical grid 244 may be or include an electrical grid, an electrical bus (e.g., plant bus), power electronics, other electric circuits, or combinations thereof. The electrical grid 244 generally contains at least one alternating current bus, alternating current grid, alternating current circuit, or combinations thereof. In one example, the power generator 240 is a generator and is electrically and operably connected to the electrical grid 244 via the power outlet 242. In another example, the power generator 240 is an alternator and is electrically and operably connected to power electronics (not shown) via the power outlet 242. In another example, the power generator 240 is electrically connected to power electronics which are electrically connected to the power outlet 242.

The power electronics may be configured to convert the electrical power into desirable forms of electricity by modifying electrical properties, such as voltage, current, or frequency. The power electronics may include converters or rectifiers, inverters, transformers, regulators, controllers, switches, resisters, storage devices, and other power electronic components and devices. In other embodiments, the power generator 240 may contain, be coupled with, or be other types of load receiving equipment, such as other types of electrical generation equipment, rotating equipment, a gearbox (e.g., gearbox 232), or other device configured to modify or convert the shaft work created by the power turbine 228. In one embodiment, the power generator 240 is in fluid communication with a cooling loop having a radiator and a pump for circulating a cooling fluid, such as water, thermal oils, and/or other suitable refrigerants. The cooling loop may be configured to regulate the temperature of the power generator 240 and power electronics by circulating the cooling fluid to draw away generated heat.

The heat engine system 90 also provides for the delivery of a portion of the working fluid into a chamber or housing of the power turbine 228 for purposes of cooling one or more parts of the power turbine 228. In one embodiment, due to the potential need for dynamic pressure balancing within the power generator 240, the selection of the site within the heat engine system 90 from which to obtain a portion of the working fluid is critical because introduction of this portion of the working fluid into the power generator 240 should respect or not disturb the pressure balance and stability of the power generator 240 during operation. Therefore, the pressure of the working fluid delivered into the power generator 240 for purposes of cooling is the same or substantially the same as the pressure of the working fluid at an inlet of the power turbine 228. The working fluid is conditioned to be at a desired temperature and pressure prior to being introduced into the power turbine 228. A portion of the working fluid, such as the spent working fluid, exits the power turbine 228 at an outlet of the power turbine 228 and is directed to one or more heat exchangers or recuperators, such as recuperators 216 and 218. The recuperators 216 and 218 may be fluidly coupled to the working fluid circuit 202 in series with each other. The recuperators 216 and 218 are operative to transfer thermal energy between the high pressure side and the low pressure side of the working fluid circuit 202.

In one embodiment, the recuperator 216 is fluidly coupled to the low pressure side of the working fluid circuit 202, disposed downstream from a working fluid outlet on the power turbine 228, and disposed upstream to the recuperator 218 and/or the condenser 274. The recuperator 216 is configured to remove at least a portion of thermal energy from the working fluid discharged from the power turbine 228. In addition, the recuperator 216 is also fluidly coupled to the high pressure side of the working fluid circuit 202, disposed upstream to the heat exchanger 120 and/or a working fluid inlet on the power turbine 228, and disposed downstream from the heat exchanger 130. The recuperator 216 is configured to increase the amount of thermal energy in the working fluid prior to flowing into the heat exchanger 120 and/or the power turbine 228. Therefore, the recuperator 216 is operative to transfer thermal energy between the high pressure side and the low pressure side of the working fluid circuit 202. In some examples, the recuperator 216 may be a heat exchanger configured to cool the low pressurized working fluid discharged or downstream from the power turbine 228 while heating the high pressurized working fluid entering into or upstream to the heat exchanger 120 and/or the power turbine 228.

Similarly, in another embodiment, the recuperator 218 is fluidly coupled to the low pressure side of the working fluid circuit 202, disposed downstream from a working fluid outlet on the power turbine 228 and/or the recuperator 216, and disposed upstream to the condenser 274. The recuperator 218 is configured to remove at least a portion of thermal energy from the working fluid discharged from the power turbine 228 and/or the recuperator 216. In addition, the recuperator 218 is also fluidly coupled to the high pressure side of the working fluid circuit 202, disposed upstream to the heat exchanger 150 and/or a working fluid inlet on a drive turbine 264 of turbopump 260, and disposed downstream from a working fluid outlet on the pump portion 262 of turbopump 260. The recuperator 218 is configured to increase the amount of thermal energy in the working fluid prior to flowing into the heat exchanger 150 and/or the drive turbine 264. Therefore, the recuperator 218 is operative to transfer thermal energy between the high pressure side and the low pressure side of the working fluid circuit 202. In some examples, the recuperator 218 may be a heat exchanger configured to cool the low pressurized working fluid discharged or downstream from the power turbine 228 and/or the recuperator 216 while heating the high pressurized working fluid entering into or upstream to the heat exchanger 150 and/or the drive turbine 264.

A cooler or a condenser 274 may be fluidly coupled to and in thermal communication with the low pressure side of the working fluid circuit 202 and may be configured or operative to control a temperature of the working fluid in the low pressure side of the working fluid circuit 202. The condenser 274 may be disposed downstream from the recuperators 216 and 218 and upstream to the start pump 280 and the turbopump 260. The condenser 274 receives the cooled working fluid from the recuperator 218 and further cools and/or condenses the working fluid which may be recirculated throughout the working fluid circuit 202. In many examples, the condenser 274 is a cooler and may be configured to control a temperature of the working fluid in the low pressure side of the working fluid circuit 202 by transferring thermal energy from the working fluid in the low pressure side to a cooling loop or system outside of the working fluid circuit 202.

A cooling media or fluid is generally utilized in the cooling loop or system by the condenser 274 for cooling the working fluid and removing thermal energy outside of the working fluid circuit 202. The cooling media or fluid flows through, over, or around while in thermal communication with the condenser 274. Thermal energy in the working fluid is transferred to the cooling fluid via the condenser 274. Therefore, the cooling fluid is in thermal communication with the working fluid circuit 202, but not fluidly coupled to the working fluid circuit 202. The condenser 274 may be fluidly coupled to the working fluid circuit 202 and independently fluidly coupled to the cooling fluid. The cooling fluid may contain one or multiple compounds and may be in one or multiple states of matter. The cooling fluid may be a media or fluid in a gaseous state, a liquid state, a subcritical state, a supercritical state, a suspension, a solution, derivatives thereof, or combinations thereof.

In many examples, the condenser 274 is generally fluidly coupled to a cooling loop or system (not shown) that receives the cooling fluid from a cooling fluid return 278*a* and returns the warmed cooling fluid to the cooling loop or system via a cooling fluid supply 278*b*. The cooling fluid may be water, carbon dioxide, or other aqueous and/or organic fluids (e.g., alcohols and/or glycols), air or other gases, or various mixtures thereof that is maintained at a lower temperature than the temperature of the working fluid. In other examples, the cooling media or fluid contains air or another gas exposed to the condenser 274, such as an air steam blown by a motorized fan or blower. A filter 276 may be disposed along and in fluid communication with the cooling fluid line at a point downstream from the cooling fluid supply 278*b* and upstream to the condenser 274. In some examples, the filter 276 may be fluidly coupled to the cooling fluid line within the process system 210.

Figure 3:
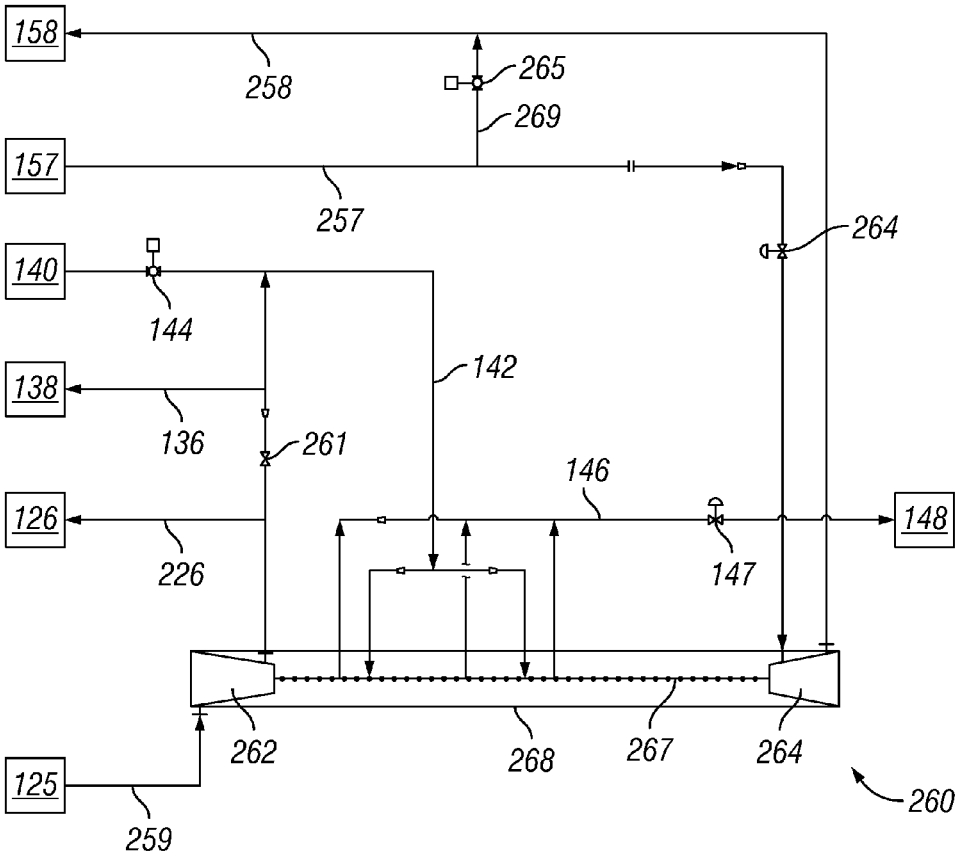
FIG. 3 illustrates an embodiment of the turbopump shown in the heat engine system of FIG. 2.

FIG. 3 illustrates one configuration of the working fluid systems in accordance with disclosed embodiments. In the illustrated embodiment, the working fluid may flow through the working fluid circuit 202 from a turbopump supply 125 and into the turbo pump inlet line 259 of the pump portion 262 of the turbopump 260. Once the working fluid has passed through the pump portion 262, the working fluid may flow through the turbopump bypass line 226 along the turbopump bypass 126, through the turbopump discharge line 136 along the turbopump discharge 138, and/or though the bearing gas supply line 142 to the bearing housing 268 of the turbopump 260. In some examples, a portion of the working fluid may combine with the bearing gas or other gas along the bearing gas supply line 142. The drive turbine 264 of the turbopump 260 may be fed by the heat exchanger discharge 157 that contains heated working fluid flowing from the heat exchanger 150 through the drive turbine inlet line 257. Once the heated working fluid passes through the drive turbine 264, the working fluid flows though the drive turbine outlet line 258 to the drive turbine discharge 158.

Figure 4:
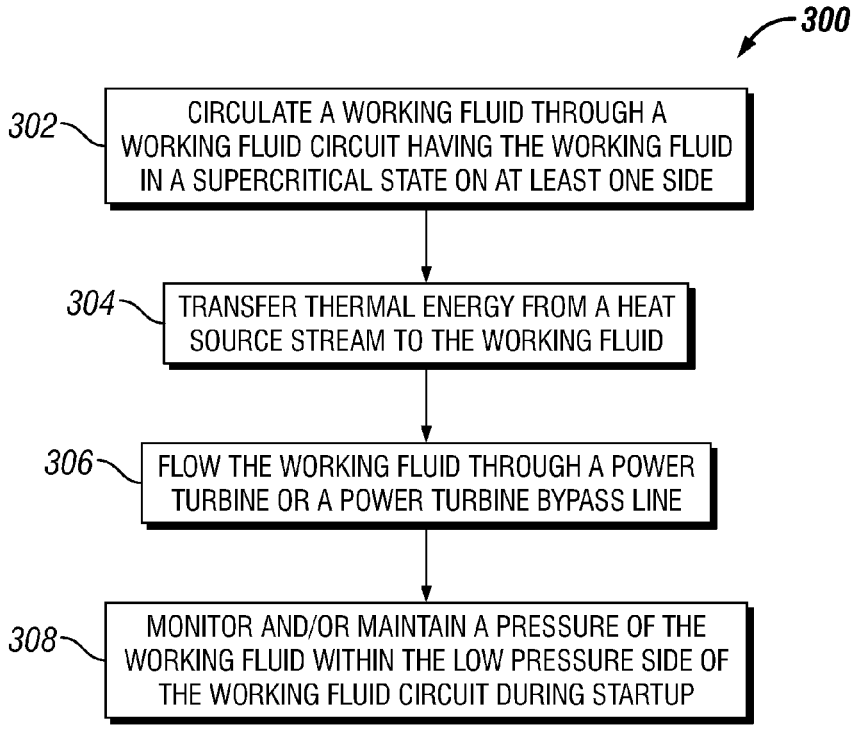
FIG. 4 is a flowchart illustrating an embodiment of a method for starting a heat engine system while reducing or preventing the likelihood of damage to one or more components of the system.

FIG. 4 illustrates an embodiment of a method 300 for starting a heat engine system 90 while reducing or preventing the likelihood of damage to one or more components of the system. The method 300 includes circulating a working fluid within a working fluid circuit 202 by a pump system such that the working fluid is maintained in a supercritical state on at least one side of the working fluid circuit (block 302). For example, in one embodiment, the working fluid is circulated such that the working fluid circuit 202 has a high pressure side containing the working fluid in a supercritical state and a low pressure side containing the working fluid in a subcritical state or a supercritical state. The pump system used to circulate the working fluid may contain a turbopump, a start pump, a combination of a turbopump and a start pump, a transfer pump, other pumps, or combinations thereof, as described in detail above. However, in some embodiments, the pump system may include at least a turbopump, such as the turbopump 260.

The method 300 further includes transferring thermal energy from a heat source stream 110 to the working fluid (block 304), for example, by utilizing at least a primary heat exchanger, such as the heat exchanger 120, fluidly coupled to and in thermal communication with the high pressure side of the working fluid circuit 202. The method 300 further includes flowing the working fluid through a power turbine 228 or through a power turbine bypass line 208 circumventing the power turbine 228 (block 306). The power turbine 228 may be configured to convert the thermal energy from the working fluid to mechanical energy of the power turbine 228 and also the power turbine 228 may be coupled to a power generator 240 configured to convert the mechanical energy into electrical energy.

In addition, the method 300 includes monitoring and/or maintaining a pump suction pressure of the working fluid within the low pressure side of the working fluid circuit 202 upstream to an inlet on the pump portion 262 of the turbopump 260 via the process control system 204 operatively connected to the working fluid circuit 202 (block 308). Generally, the inlet on the pump portion 262 of the turbopump 260 and the low pressure side of the working fluid circuit 202 contain the working fluid in the supercritical state during a startup procedure. Therefore, in some embodiments, the pump suction pressure may be maintained at but generally greater than the critical pressure of the working fluid during the startup procedure.

In another embodiment, a method for starting the heat engine system 90 includes circulating a working fluid within a working fluid circuit 202 by a pump system, such that the working fluid circuit 202 has a high pressure side containing the working fluid in a supercritical state and a low pressure side containing the working fluid in a subcritical state or a supercritical state. As before, this embodiment of the method further includes transferring thermal energy from a heat source stream 110 to the working fluid by at least a heat exchanger 120 fluidly coupled to and in thermal communication with the high pressure side of the working fluid circuit 202 and flowing the working fluid through a power turbine 228 or through a power turbine bypass line 208 circumventing the power turbine 228. Generally, the power turbine 228 may be configured to convert the thermal energy from the working fluid to mechanical energy of the power turbine 228 and also the power turbine 228 may be coupled to a power generator 240 configured to convert the mechanical energy into electrical energy.

Additionally, as before, the method further includes monitoring and maintaining a pressure of the working fluid within the low pressure side of the working fluid circuit 202 via the process control system 204 operatively connected to the working fluid circuit 202, such that the low pressure side of the working fluid circuit 202 contains the working fluid in the supercritical state during a startup procedure. However, in this embodiment, during step 308, the working fluid in the low pressure side is maintained at least at the critical pressure, but generally above the critical pressure of the working fluid during the startup procedure. In some embodiments, such as for the working fluid containing carbon dioxide and disposed, flowing, or circulating within the low pressure side of the working fluid circuit 202, the value of the critical pressure is generally greater than 5 MPa, such as about 7 MPa or greater, for example, about 7.38 MPa. Therefore, in some examples, the working fluid containing carbon dioxide in the low pressure side may be maintained at a pressure within a range from about 5 MPa to about 15 MPa, more narrowly within a range from about 7 MPa to about 12 MPa, more narrowly within a range from about 7.38 MPa to about 10.4 MPa, and more narrowly within a range from about 7.38 MPa to about 8 MPa during the startup procedure.

The method may further include increasing the flowrate or temperature of the working fluid within the working fluid circuit 202 and circulating the working fluid by a turbopump, such as the turbopump 260 contained within the pump system during the startup procedure. In some configurations, the pump system of the heat engine system 90 or 200 may have one or more pumps, such as a turbopump, such as the turbopump 260, and/or a start pump, such as the start pump 280. In some examples, the pump system may include a turbopump, a mechanical start pump, an electric start pump, or a combination of a turbopump 260 and a start pump, as described in more detail above.

The method may also include circulating the working fluid by the turbopump 260 during a load ramp procedure or a full load procedure subsequent to the startup procedure, such that the flowrate or temperature of the working fluid sustains the turbopump 260 during the load ramp procedure or the full load procedure. In some configurations, the heat engine system 90 may have a secondary heat exchanger and/or a tertiary heat exchanger, such as the heat exchangers 150, 130, configured to heat the working fluid. Generally, the heat exchanger 150 or another heat exchanger may be configured to heat the working fluid upstream to an inlet on a drive turbine of the turbopump 260, such as during the load ramp procedure or the full load procedure. In some examples, one or more of the heat exchanger 120, the heat exchanger 130, and/or the heat exchanger 150 may reach a steady state during the load ramp procedure or the full load procedure.

In other embodiments, the method includes decreasing the pressure of the working fluid within the low pressure side of the working fluid circuit 202 via the process control system 204 during the load ramp procedure or the full load procedure. The method may also include decreasing the pressure of the working fluid within the low pressure side of the working fluid circuit 202 via the process control system 204 during the load ramp procedure or the full load procedure. In many examples, the working fluid within the low pressure side of the working fluid circuit 202 is in a subcritical state during the load ramp procedure or the full load procedure. The working fluid in the subcritical state is generally in a liquid state and free or substantially free of a gaseous state. Therefore, the working fluid in the subcritical state is generally free or substantially free of bubbles. In many examples, the working fluid contains carbon dioxide.

Figure 5:
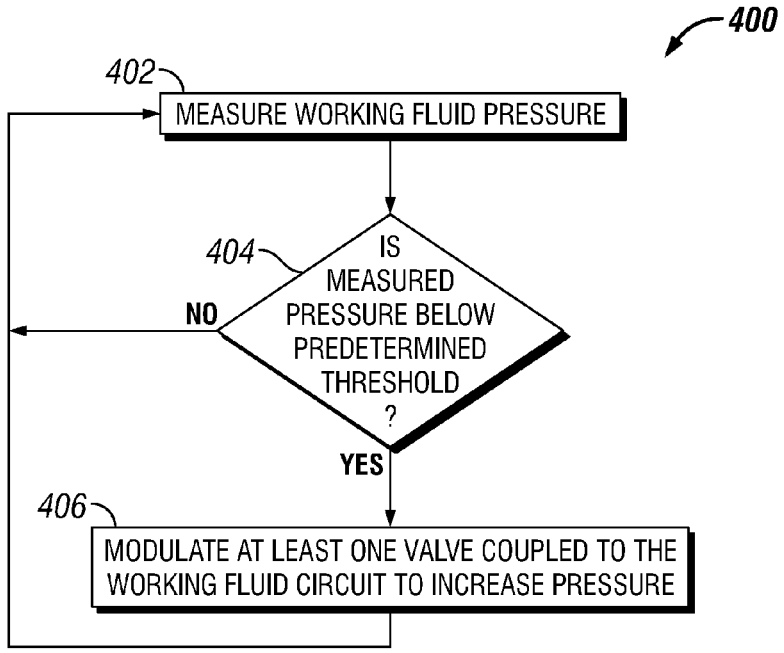
FIG. 5 is a flowchart illustrating an embodiment of a method for maintaining a pressure of a working fluid at or above a predetermined threshold.

In other embodiments, as illustrated in FIG. 5, a method 400 further includes maintaining the pressure of the working fluid at or above a predetermined threshold. For example, an embodiment of the method 400 includes measuring a pressure of the working fluid (block 402) and inquiring as to whether the measured pressure is below a predetermined threshold (block 404). In this way, the method 400 provides for detecting an undesirable value of the pressure via the process control system 204. If the pressure is below the threshold, the method 400 includes modulating at least one valve fluidly coupled to the working fluid circuit 202 with the process control system 204 to increase the pressure (block 406), for example, by increasing the flowrate of the working fluid passing or flowing through the at least one valve. Following an adjustment of the valve, the pressure is again measured (block 402) to determine if the adjustment raised the pressure above the predetermined threshold. In this way, the method 400 provides for detecting a desirable value of the pressure via the process control system 204, wherein the desirable value is at or greater than the predetermined threshold value of the pressure.

In some examples, the method further includes measuring the pressure (e.g., the pump suction pressure) of the working fluid within the low pressure side of the working fluid circuit 202 upstream to an inlet on a pump portion of a turbopump, such as the turbopump 260. The pump suction pressure may be at the critical pressure of the working fluid, but generally, the pump suction pressure is greater than the critical pressure of the working fluid at the inlet on the pump portion 262 of the turbopump 260. In other examples, the method further includes measuring the pressure of the working fluid downstream from a turbine outlet on the power turbine 228 within the low pressure side of the working fluid circuit 202. In other examples, the method further includes maintaining the pressure of the working fluid at or greater than a critical pressure value during the startup procedure. Alternatively, in other examples, the method may further include maintaining the pressure of the working fluid at less than the critical pressure value during the load ramp procedure or the full load procedure. Indeed, it should be noted that the pressure may be measured at any desirable location or locations within the working fluid circuit, not limited to those mentioned above, depending on implementation-specific considerations.

Figure 6:
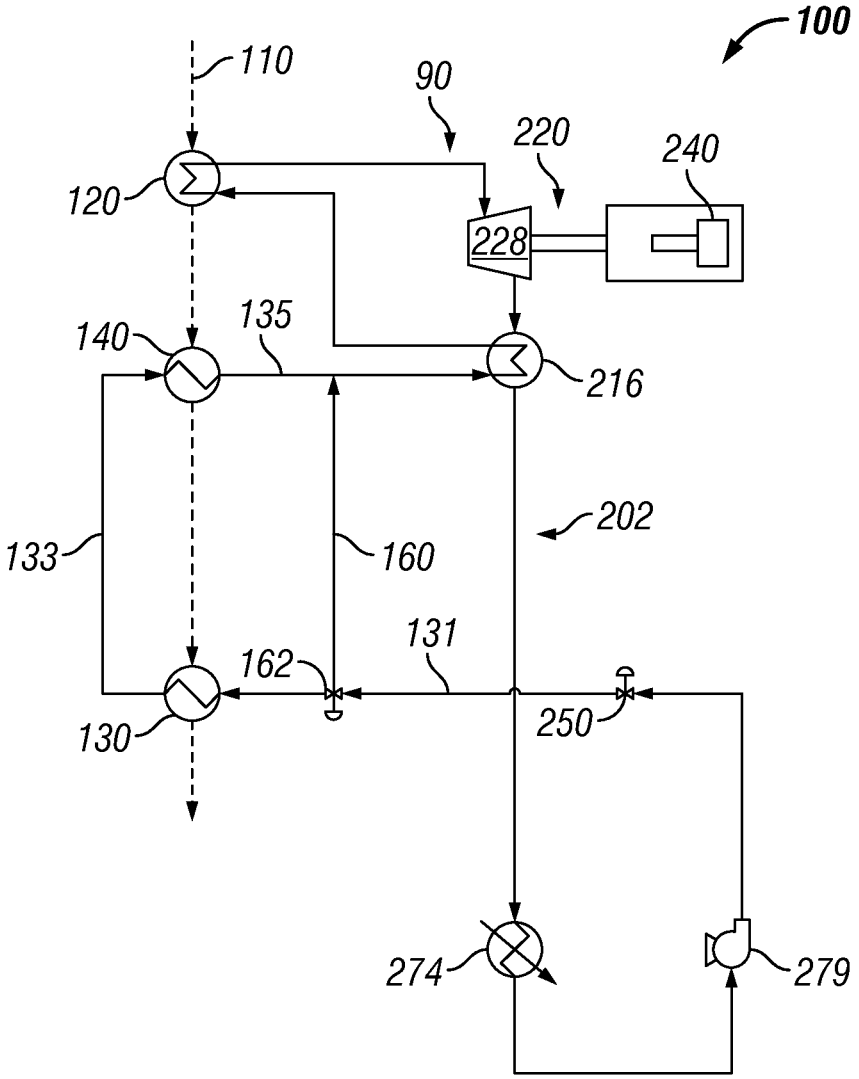
FIG. 6 illustrates an embodiment of a heat engine system having a bypass valve for enabling working fluid to bypass a heat exchanger.

FIG. 6 is a simplified embodiment of the heat engine system 90 depicted in FIG. 1 and illustrates the placement and function of the bypass line 160 and bypass valve 162 in detail. More particularly, FIG. 6 depicts a bypass line 160 fluidly coupled to a fluid line 131 of the working fluid circuit 202 upstream to the heat exchangers 120, 130, and 140 by a bypass valve 162. During operation, the bypass valve 162 may be adjusted to multiple positions for controlling the flow of the working fluid within the working fluid circuit 202 during various segments of the electricity generation processes described herein. By adjusting the flow of the working fluid, the temperature of the working fluid may be regulated, for example, during startup to reduce or eliminate the likelihood of wear or damage to system components due to excess thermal heat.

In a first position, the bypass valve 162 may be configured to flow the working fluid from the throttle valve 250, through the fluid line 131, through the bypass valve 162, through the bypass line 160 while avoiding the heat exchangers 130 and 140 and the fluid line 133, through the fluid line 135, and then through the recuperator 216, the heat exchanger 120, the inlet of the power turbine 228, and the fluid lines therebetween. In a second position, the bypass valve 162 may be configured to flow the working fluid from the throttle valve 250, through the fluid line 131, through the bypass valve 162, through the heat exchangers 130 and 140 and the fluid line 133 while avoiding the bypass line 160, through the fluid line 135, and then through the recuperator 216, the heat exchanger 120, the inlet of the power turbine 228, and the fluid lines therebetween. In a third position, the bypass valve 162 may be configured to stop the flow the working fluid at the bypass valve 162 while avoiding the bypass line 160 and avoiding the heat exchangers 130 and 140 and the fluid line 133. In this way, the bypass line 160 and bypass valve 162 may be controlled to reduce or prevent the likelihood of damage to components of the heat engine system 90 during startup due to overheated working fluid.

In one embodiment disclosed herein, during the startup process, the working fluid initially does not flow or otherwise pass through the heat exchangers 120, 130, 140, and 150 and the temperature of the waste heat steam 110 (e.g., a gas turbine exhaust) may reach about 550° C. or greater. Therefore, the heat exchangers 120, 130, 140, and 150—generally composed of metal—absorb the thermal energy from the waste heat steam 110 and become heated, such that the temperatures of the heat exchangers 120, 130, 140, and 150 may approach the temperature of the waste heat steam 110. Generally, during the startup process, the bypass valve 162 may already be positioned to divert the working fluid around and avoid the heat exchangers 130, 150, and the optional heat exchanger 140 if present, such that the working fluid is flowed through the bypass line 160.

In some examples, if the heat exchangers 130, 140, and 150 are not bypassed at the startup, the low mass flowrate of the working fluid (e.g., $CO_2$) that initially flows through the fluid lines 133 and 135 disposed between the heat exchangers 130 and 140 and the recuperator 216 may result in the working fluid being heated to a temperature of about 550° C. at a pressure within a range from about 4.7 MPa to about 8.2 MPa. Therefore, in these examples, the inlet temperature of the recuperator 216 along the fluid line 135 may be maintained at a temperature of about 175° C. or less, such as about 172° C. or less. Failure to bypass the heat exchangers 130, 140, and 150 via the bypass line 160 during the startup process may cause overheating and possible damage to the recuperator 216 and/or other components.

Figure 7:
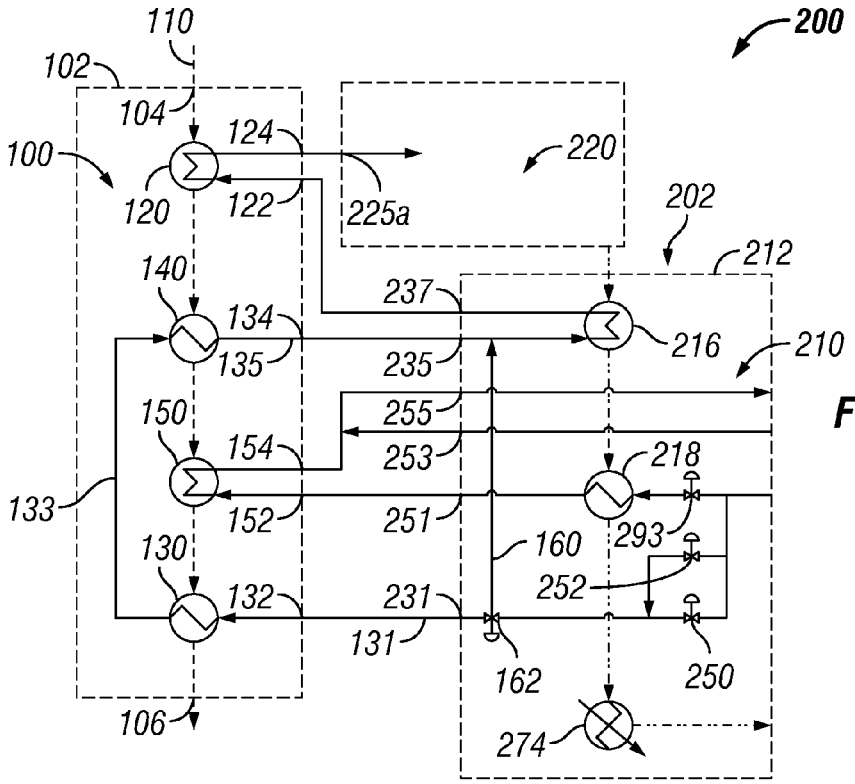
FIG. 7 illustrates a first positioning of the bypass valve of FIG. 8 in accordance with one embodiment.
Figure 8:
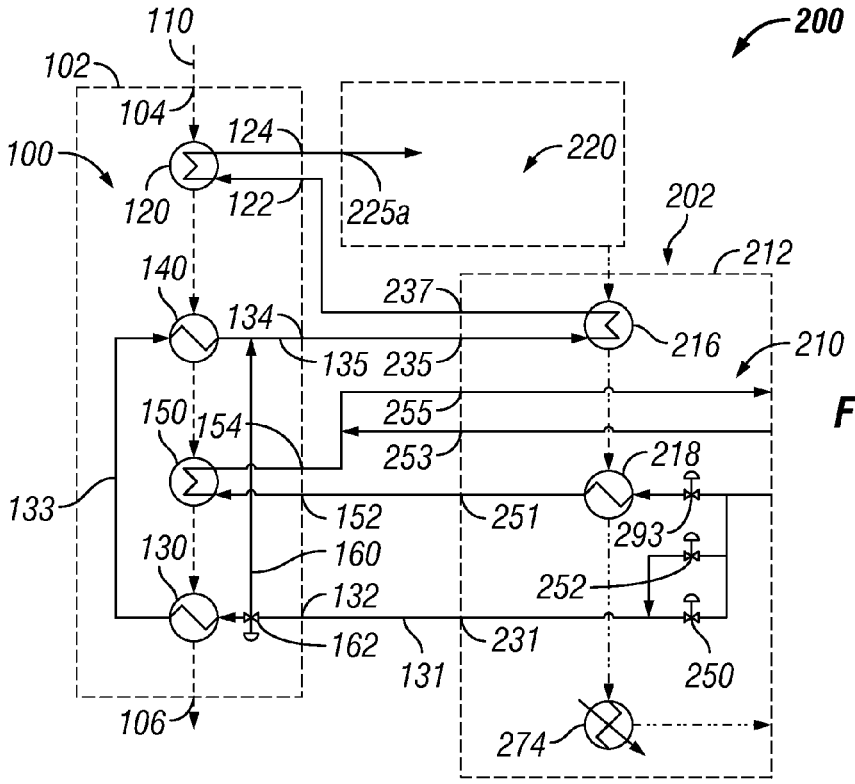
FIG. 8 illustrates a second positioning of the bypass valve of FIG. 8 in accordance with one embodiment.
Figure 9:
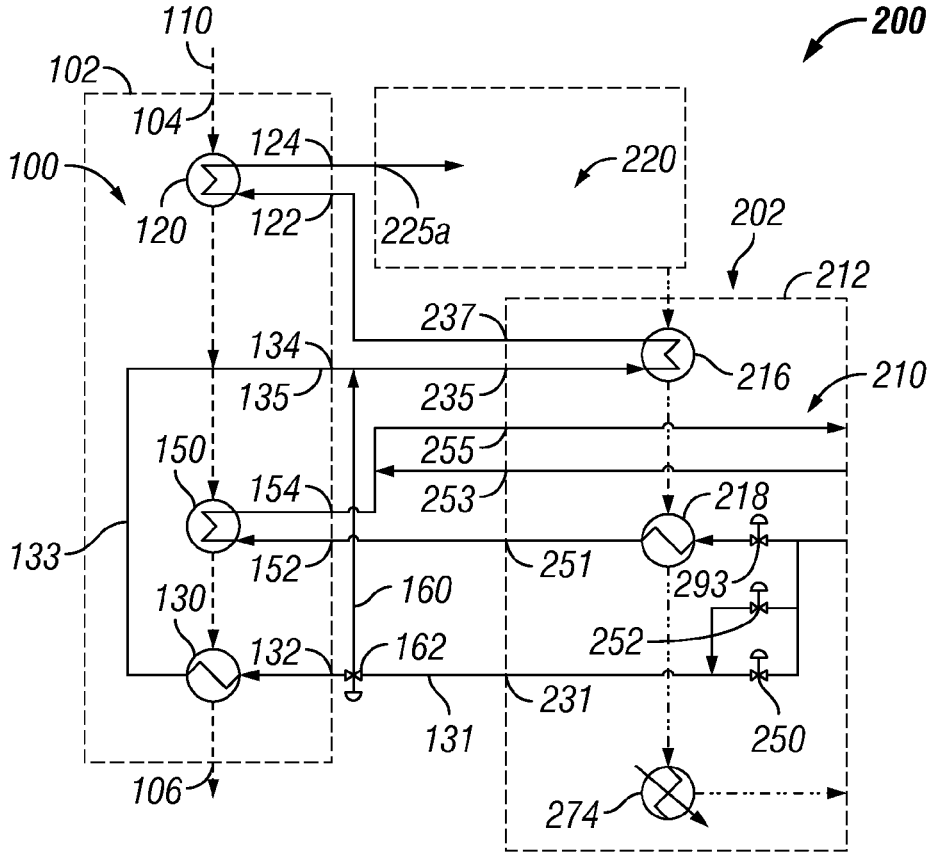
FIG. 9 illustrates a third positioning of the bypass valve of FIG. 8 in accordance with one embodiment.

It should be noted that the position of the bypass line 160 and the bypass valve 162 within the heat engine system may be varied in certain embodiments, depending on implementation-specific considerations. FIGS. 7-9 illustrate suitable positions for the bypass line 160 and bypass valve 162 in accordance with some embodiments, but the illustrated positions are merely examples and are not meant to limit the positions possible in other embodiments. Indeed, the bypass line 160 and/or the bypass valve 162 may be positioned in any location that enables the bypass valve 162 to redirect the flow of the working fluid to place one or more of the heat exchangers 120, 130, 140, and 150 in or out of the working fluid flow path.

In the embodiment of FIG. 7, the heat engine system 90 contains the bypass line 160 and the bypass valve 162 disposed within the main process skid 212. In this embodiment, the bypass valve 162 is fluidly coupled to the fluid line 131 extending between the throttle valve 250 and the heat exchanger 130, more specifically, fluidly coupled to a segment of the fluid line 131 extending between and in fluid communication with the throttle valve 250 and the outlet 231 of the main process skid 212. The fluid line 131 further extends through and is in fluid communication with the inlet 132 of the waste heat skid 102. One end of the bypass line 160 may be fluidly coupled to the fluid line 131 by the bypass valve 162. The other end of the bypass line 160 may be fluidly coupled to the fluid line 135 at a point downstream from the heat exchanger 130, upstream to the recuperator 216, and within the main process skid 212.

More specifically, the other end of the bypass line 160 may be fluidly coupled to a segment of the fluid line 135 extending between and in fluid communication with the inlet 235 of the main process skid 212 and the recuperator 216. In one embodiment, the fluid line 135 extends between and in fluid communication to the heat exchanger 140 and the recuperator 216, as depicted in FIG. 7. In another embodiment, the heat exchanger 140 and the fluid line 133 are omitted, the fluid line 135 extends between and in fluid communication to the heat exchanger 130 and the recuperator 216, and the other end of the bypass line 160 may be fluidly coupled to a segment of the fluid line 135 extending between and in fluid communication with the inlet 235 of the main process skid 212 and the recuperator 216 (not shown).

In other embodiments, the heat engine system 90 contains the bypass line 160 and the bypass valve 162 disposed within the waste heat skid 102, as depicted in FIG. 8. The bypass valve 162 may be fluidly coupled to the fluid line 131 extending between the throttle valve 250 and the heat exchanger 130, more specifically, fluidly coupled to a segment of the fluid line 131 extending between and in fluid communication with the inlet 132 of the waste heat skid 102 and the heat exchanger 130. One end of the bypass line 160 may be fluidly coupled to the fluid line 131 by the bypass valve 162. The other end of the bypass line 160 may be fluidly coupled to the fluid line 135 at a point downstream from the heat exchanger 130, upstream to the recuperator 216, and within the waste heat skid 102.

More specifically, the other end of the bypass line 160 may be fluidly coupled to a segment of the fluid line 135 extending between and in fluid communication with the heat exchanger 140 and the outlet 134 of the waste heat skid 102. In one embodiment, the fluid line 135 extends between and in fluid communication to the heat exchanger 140 and the recuperator 216, as depicted in FIG. 8. In another embodiment, the heat exchanger 140 and the fluid line 133 are omitted, the fluid line 135 extends between and in fluid communication to the heat exchanger 130 and the recuperator 216, and the other end of the bypass line 160 may be fluidly coupled to a segment of the fluid line 135 extending between and in fluid communication with the heat exchanger 130 and the outlet 134 of the waste heat skid 102 (not shown).

In the embodiment of FIG. 9, the heat engine system 90 includes the bypass line 160 and the bypass valve 162 disposed between the waste heat skid 102 and the main process skid 212. The bypass valve 162 may be fluidly coupled to the fluid line 131 extending between the throttle valve 250 and the heat exchanger 130, more specifically, fluidly coupled to a segment of the fluid line 131 extending between and in fluid communication with the outlet 231 of the main process skid 212 and the inlet 132 of the waste heat skid 102. One end of the bypass line 160 may be fluidly coupled to the fluid line 131 by the bypass valve 162. The other end of the bypass line 160 may be fluidly coupled to the fluid line 135 at a point downstream from the heat exchanger 130, upstream to the recuperator 216, and between the waste heat skid 102 and the main process skid 212. More specifically, the other end of the bypass line 160 may be fluidly coupled to a segment of the fluid line 135 extending between and in fluid communication with the outlet 134 of the waste heat skid 102 and the inlet 235 of the main process skid 212. In one embodiment, the fluid line 135 extends between and is in fluid communication with the heat exchanger 140 and the recuperator 216, as depicted in FIG. 1. In another embodiment, the fluid line 135 extends between and is in fluid communication with the heat exchanger 130 and the recuperator 216, as depicted in FIG. 9.

In some embodiments, as depicted in FIG. 9, the heat exchangers 130, 140, and 150 may be bypassed from initial start through power turbine part power until the working fluid flow through the heat exchangers 120 and 150 reaches full design flow rate. Once the full design flow rate of the working fluid has been achieved, the temperature of the waste heat steam 110 exiting the heat exchanger 120 will be low enough to allow additional heat recovery from the heat exchangers 130, 140, and 150 without overheating the recuperator 216. At this point, the bypass valve 162 may be switched to allow the working fluid to flow through the heat exchanger 130, resulting in additional heat recovery and higher power turbine output without damage to the recuperator 216.

Further, provided herein are methods for managing the "thermal transients" present as the heat engine system 90 approaches full power during an electricity generation process. For example, the methods may include controlling the bypass valve 162 such that the working fluid may be by-passed around to avoid one or more heat exchangers (e.g., 130, 140, 150) during startup until the process is ready to handle the increased thermal energy imparted to the working fluid within the working fluid circuit 202 by the waste heat stream. Implementation of one or more of the following methods may reduce or eliminate the likelihood of damage to components of the heat engine system during startup due to the high temperature of the waste heat flue.

Figure 10:
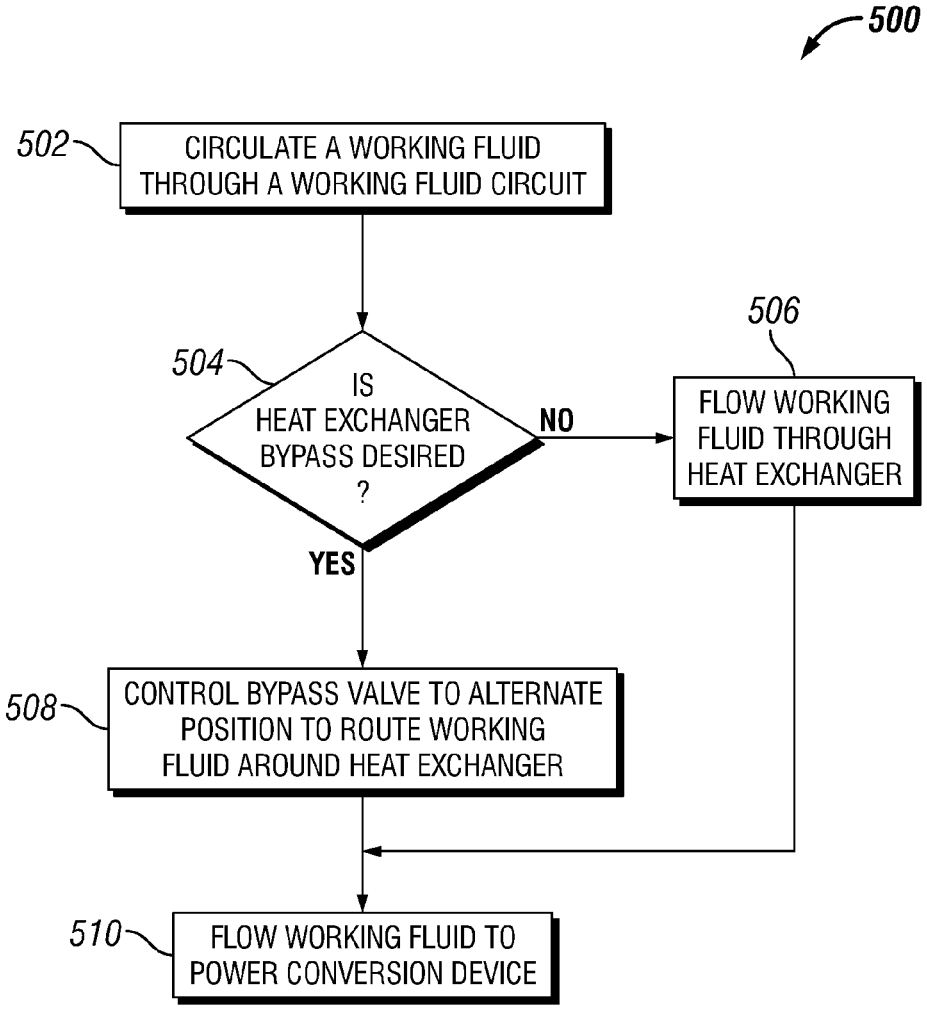
FIG. 10 illustrates an embodiment of a method for bypassing one or more heat exchangers in a heat engine system.

In the embodiment of FIG. 10, a method 500 is provided for rerouting the working fluid to avoid flow through one or more heat exchangers, for example, during startup of the heat engine system 90. The method 500 includes circulating a working fluid through a working fluid circuit (block 502) and inquiring as to whether bypass of the heat exchanger is desired (block 504). For example, a controller may receive feedback from one or more temperature or pressure sensors within the system 90 to determine whether it is desirable to raise the temperature of the working fluid by flowing the working fluid through the heat exchangers, or to reduce or maintain the working fluid temperature by bypassing the heat exchangers.

If it is desirable to raise the working fluid temperature, then the working fluid is directed through the heat exchanger (block 506). However, if bypass is desired, for example, during startup, then the position of the bypass valve is controlled to effectuate routing of the working fluid around the heat exchanger (block 508) and to the power conversion device, such as power turbine 228 (block 510).

Figure 11:
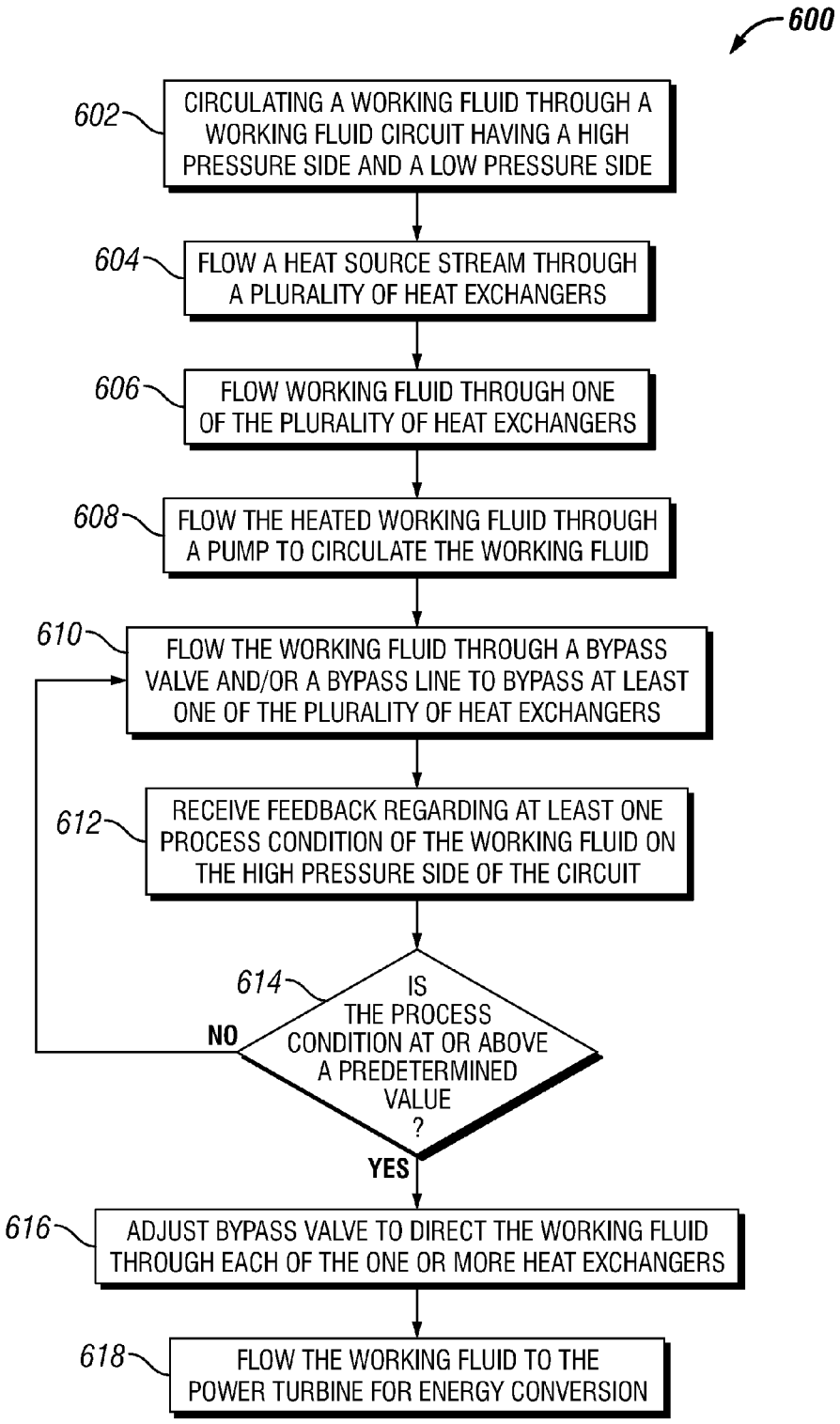
FIG. 11 illustrates an embodiment of a method for controlling a bypass system based on one or more monitored parameters of a working fluid.

In another embodiment shown in FIG. 11, a method 600 is provided for routing of the working fluid to or around one or more heat exchangers in a manner that reduces or eliminates the likelihood of damage to one or more components in the heat engine system 90. The method 600 includes circulating a working fluid (e.g., sc-$CO_2$) within a working fluid circuit 202 having a high pressure side and a low pressure side (block 602) and flowing a heat source stream 110 through two or more heat exchangers disposed within the waste heat system 100 (block 604).

In some examples, the one or more heat exchangers include a primary heat exchanger and a tertiary heat exchanger, such as the heat exchangers 120 and 130, respectively. In other examples, a plurality of heat exchangers includes at least the primary and tertiary heat exchangers (e.g., heat exchangers 120 and 130, respectively), as well as a secondary heat exchanger, such as the heat exchanger 150, and/or an optional quaternary heat exchanger, such as the heat exchanger 140. Each of the heat exchangers 120, 130, 140, and 150 may be fluidly coupled to and in thermal communication with the heat source stream 110, and independently, fluidly coupled to and in thermal communication with the working fluid within the working fluid circuit 202.

The method 600 further includes flowing the working fluid through one or more heat exchangers (block 606) and through a pump that circulates the working fluid through the working fluid circuit (block 608). Additionally, the method 600 provides for flowing the working fluid through a bypass valve and/or bypass line to bypass one or more of the remaining heat exchangers (block 610) to avoid overheating the working fluid, for example, during a startup procedure. It should be noted that the foregoing steps may be performed in any desired order, not limited to the order in which they are presented in FIG. 11. For instance, one or more of the heat exchangers may be bypassed prior to flowing the working fluid through another one of the heat exchangers.

For example, in one embodiment, the method 600 may include flowing the working fluid through the fluid line 131 and then through a bypass valve 162 and a bypass line 160 while avoiding the flow of the working fluid through the heat exchanger 130 and the fluid line 133. The bypass line 160 may be fluidly coupled to the working fluid circuit 202 upstream to the heat exchanger 130 via the bypass valve 162, fluidly coupled to the working fluid circuit 202 downstream from the heat exchanger 130, and configured to circumvent the working fluid around the heat exchanger 130 and the fluid line 133. Subsequently, the method 600 may include flowing the working fluid from the bypass line 160, through the fluid line 135, through other lines within the working fluid circuit 202, and then to the heat exchanger 120. The working fluid flows through the heat exchanger 120 while thermal energy is transferred from the heat source stream 110 to the working fluid within the high pressure side of the working fluid circuit 202 via the heat exchanger 120.

In one aspect, both the temperature of working fluid and the power demand increase as the heat engine system 200 initially starts an electricity generation process. As the heat engine system 200 approaches full power, the bypass valve 162 and the bypass line 160 are utilized to provide additional control while managing the rising temperature of the working fluid within the working fluid circuit 202. The bypass valve 162 and the bypass line 160 are configured and adjusted to circumvent the flow of the working fluid around at least one or more of the heat exchangers, such as the heat exchangers 130 and 140, and to provide the flow of the working fluid upstream of the heat exchanger 120. By avoiding the heat exchanger 130 and/or the heat exchanger 140 during the initial stage of the electricity generation process, the working fluid is prevented from absorbing too much thermal energy and damaging the recuperator 216, and other components of the working fluid circuit 202. Therefore, the additional controllability of the temperature of the working fluid via the bypass valve 162 and the bypass line 160 provides improved and safer maintenance of the working fluid in a supercritical state and also provides a reduction or elimination of thermal stress on mechanical parts of the heat engine system 200, such as the turbo unit or turbine unit in the turbopump 260 and/or the power turbine 228.

Additionally, the method 600 includes monitoring and receiving feedback regarding at least one process condition (e.g., a process temperature, pressure, and/or flowrate) of the working fluid within the high pressure side of the working fluid circuit 202 (block 612) and inquiring as to whether the process condition is at or above a predetermined value (block 614). Once the predetermined value is detected for at least one of the process conditions of the working fluid, a subsequent adjustment is made to the bypass valve 162 to divert the working fluid to avoid the bypass line 160 while directing the flow towards the heat exchanger 130 (block 616).

In some embodiments, the predetermined value of the process temperature of the working fluid may be within a range from about 150° C. to about 180° C., more narrowly within a range from about 165° C. to about 175° C. during the startup process, as detected at the point on the working fluid circuit 202 disposed downstream from the (tertiary) heat exchanger 130 and upstream to the recuperator 216. The working fluid containing carbon dioxide and at least a portion of the working fluid may be in a supercritical state within the high pressure side of the working fluid circuit 202. Generally, during the startup process, the predetermined pressure of the working fluid as detected at the point on the working fluid circuit 202 may be within a range from about 4 MPa to about 10 MPa.

The heat exchanger 130 is generally fluidly coupled to the working fluid circuit 202 upstream to the heat exchanger 120 via line 133, line 135, and other fluid lines therebetween. Once the predetermined value for the process condition of the working fluid is detected and the bypass valve 162 is adjusted, the working fluid flows from the bypass valve 162 serially through the heat exchanger 130 and the heat exchanger 120 while thermal energy is transferred from the heat source stream 110 to the working fluid within the high pressure side of the working fluid circuit 202.

For example, once the heat engine system 200 drawing thermal energy from the heat exchanger 120 achieves full power or substantially full power during the electricity generation process, additional thermal energy may be provided by bringing the heat exchanger 130, the heat exchanger 140, and/or the heat exchanger 150 into fluid and thermal communication with the working fluid. The bypass valve 162 and the fluid line 133 are configured to circumvent the flow of the working fluid around the bypass line 160 and provide the flow of the working fluid through the heat exchanger 130, the heat exchanger 140, and/or the heat exchanger 150 prior to flowing the working fluid through the heat exchanger 120.

Thereafter, the method 600 includes flowing the working fluid from the heat exchanger 120 to a power turbine 228, transforming thermal energy of the working fluid to mechanical energy of the power turbine 228 by a pressure drop in the working fluid, and converting the mechanical energy into electrical energy by a power generator 240 coupled to the power turbine 228 (block 618). The power turbine 228 may be disposed between the high pressure side and the low pressure side of the working fluid circuit 202 and fluidly coupled to and in thermal communication with the working fluid.

In some examples, the method 600 further includes flowing the working fluid through the heat exchanger 150 (e.g., the secondary heat exchanger) while thermal energy is transferred from the heat source stream 110 to the working fluid within the high pressure side of the working fluid circuit 202 via the heat exchanger 150, and subsequently flowing the heated working fluid through the turbopump 260 configured to circulate the working fluid within the working fluid circuit 202.

In one embodiment, both the temperature of working fluid and the power demand increase as the heat engine system 90 initially starts an electricity generation process. As the heat engine system 90 approaches full power, the bypass valve 162 and the bypass line 160 are utilized to provide additional control while managing the rising temperature of the working fluid within the working fluid circuit 202. The bypass valve 162 and the bypass line 160 are configured and adjusted to circumvent the flow of the working fluid around at least one or more of the heat exchangers, such as the heat exchangers 130 and 140, and to provide the flow of the working fluid upstream of the heat exchanger 120. By avoiding the heat exchanger 130 and/or the heat exchanger 140 during the initial stages of the electricity generation process (e.g., a startup process), the working fluid is prevented from absorbing too much thermal energy and damaging the recuperator 216, and other components of the working fluid circuit 202. Therefore, the additional controllability of the temperature of the working fluid via the bypass valve 162 and the bypass line 160 provides improved and safer maintenance of the working fluid in a supercritical state and also provides a reduction or elimination of thermal stress on mechanical parts of the heat engine system 90, such as the turbo unit or turbine unit in the pump 279 and/or the power turbine 228.

Again, certain embodiments of the heat engine systems provided above may enable a reduction or elimination of wear or damage to one or more system components. For example, in embodiments described herein, cavitation of pumps may be avoided by maintaining the working fluid containing carbon dioxide as a liquid. During startup, in a heat-saturated heat exchanger situation (e.g., where the waste heat flue is already operational), the low pressure of the working fluid containing carbon dioxide may be subjected to additional pressurization, which will tend to push the working fluid containing carbon dioxide towards a liquid-type state, such as a supercritical fluid state. The working fluid containing carbon dioxide may be utilized in a supercritical state (e.g., sc-$CO_2$) and disposed on the low pressure side during system startup to reduce the likelihood that pump cavitation will occur.

More particularly, embodiments of the invention include a heat engine system and process that employs additional pressurization to maintain the working fluid containing carbon dioxide on the low pressure side in supercritical state. This is counter-intuitive to most systems, as power is derived from the pressure ratio. Therefore, movement in the low pressure side has a large effect on the efficiency and power of the system. However, providing the working fluid containing carbon dioxide in supercritical state reduces or removes the possibility of cavitation in the pump. Once the main pump (e.g., turbopump) may be ramped up to self-sustaining levels and the temperature of the heat exchangers reaches steady state, the working fluid containing carbon dioxide on the low pressure side may be reduced back into normal low pressure liquid phase, such that at least a portion of the working fluid is in a subcritical state.

Further, in order to manage the "thermal transients" as the heat engine system approaches full power during an electricity generation process and avoid damage to system components, the working fluid may be by-passed around to avoid one or more heat exchangers (e.g., 130, 140, 150) until the process is ready to handle the increased thermal energy imparted to the working fluid within the working fluid circuit. To that end, as discussed in detail above, a bypass valve may be disposed along an output line from a start pump and/or a turbopump and used to divert the flow of the working fluid through a bypass line and past the heat exchangers to introduce the working fluid at a location upstream to the inlet of a power conversion device, such as a power turbine.

In such embodiments, thermal energy imparted into the working fluid in a supercritical state is greatly reduced by circumventing the working fluid around and avoiding the passage of the working fluid through one, two, three, or more waste heat exchangers, such as the heat exchangers 130, 140, and 150. In one embodiment, a single heat exchanger, such as the heat exchanger 120, may be utilized to heat the working fluid flowing through the working fluid circuit 202. The working fluid may be circulated multiple times through the single heat exchanger 120 by recirculating the working fluid through the working fluid circuit 202. In certain embodiments, additional control for managing the increasing temperature of the working fluid without introducing "thermal shock" may be accomplished by only using the heat exchanger 120.

In another embodiment described herein, the heat exchangers are pre-heated by the already-running main heat source during a heat saturated startup and the recuperators cannot handle the high temperature and flow of the working fluid. Therefore, the working fluid may be rerouted around the recuperators.

In another embodiment described herein, during the operation of a gas turbine, which acts as a heat source for the present heat engine system, there are times when the gas turbine is operated at reduced flow rates. At such times, full running of the heat engine system results in an insufficient heating of the working fluid (e.g., sc-$CO_2$). Therefore, one or more recirculation lines are used to reduce the flow rate of the working fluid within the working fluid circuit. The pump has an optimal efficiency, so simply reducing flow is generally not the most efficient option. To reduce the flow rate, the recirculation lines connect the main pump to a point upstream of the condenser to shunt flow around the waste heat exchangers and expanders and route the working fluid back to the cold side.

In one or more embodiments, a gas turbine is utilized as a heat source for providing the heat source stream 110 flowing through the waste heat system 100. There are times when the gas turbine is operated at less than full capacity and the heat source stream 110 has a reduced flowrate. At such times, full running of the heat engine system 200 results in an insufficient heating of the working fluid (e.g., sc-CO2). Therefore, one or more recirculation or fluid lines, such as fluid lines 244 and/or 226, are utilized to reduce the flow rate of the working fluid within the working fluid circuit 202. Again, the turbopump 260 has an optimal efficiency, so simply reducing flow is generally not the most efficient option. The relative flow rate of the working fluid is decreased by increasing the distance the working fluid flows while at the same actual flowrate. A fluid line 226 and bypass valve 256 may be fluidly coupled to the working fluid circuit 202 between the pump portion 262 of the turbopump 260 and a point on the fluid line 229 between the recuperator 218 and the condenser 274. Such point on the fluid line 229 is downstream from the recuperators 216 and 218 and upstream of the condenser 274. Also, a fluid line 224 and bypass valve 254 may be fluidly coupled to the working fluid circuit 202 between the pump portion 282 of the start pump 280 and the same point on the fluid line 229 between the recuperator 218 and the condenser 274.

The passageway through the fluid lines 226 and 229 or the fluid lines 224 and 229 provides a bypass around the heat exchangers 120, 130, 140, and/or 150 and the expanders, such as the power turbine 228 of the power generation system 220 and/or the drive turbine 264 of the turbopump 260. Instead, the working fluid is recirculated through the cold or low pressure side of the working fluid circuit 202.

It is to be understood that the present disclosure describes several exemplary embodiments for implementing different features, structures, or functions of the invention. Exemplary embodiments of components, arrangements, and configurations are described herein to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the present disclosure may include embodiments in which the first and second features are formed in direct contact, and may also include embodiments in which additional features may be formed interposing the first and second features, such that the first and second features may not be in direct contact. Finally, the exemplary embodiments described herein may be combined in any combination of ways, i.e., any element from one exemplary embodiment may be used in any other exemplary embodiment without departing from the scope of the disclosure.

Additionally, certain terms are used throughout the present disclosure and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the present disclosure and in the claims, the terms "including", "containing", and "comprising" are used in an open-ended fashion, and thus should be interpreted to mean "including, but not limited to". All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B", unless otherwise expressly specified herein.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A method for starting a heat engine, comprising:

circulating a working fluid within a working fluid circuit by a pump system, wherein the working fluid circuit has a high pressure side containing the working fluid in a supercritical state and a low pressure side containing the working fluid in a subcritical state or a supercritical state;

transferring thermal energy from a heat source stream to the working fluid by at least a primary heat exchanger fluidly coupled to and in thermal communication with the high pressure side of the working fluid circuit;

flowing the working fluid through a power turbine or through a power turbine bypass line circumventing the power turbine, wherein the power turbine is configured to convert the thermal energy from the working fluid to mechanical energy of the power turbine and the power turbine is coupled to a power generator configured to convert the mechanical energy into electrical energy;

monitoring and maintaining a pressure of the working fluid within the low pressure side of the working fluid circuit via a process control system operatively connected to the working fluid circuit, wherein the low pressure side of the working fluid circuit contains the working fluid in the supercritical state during a startup procedure;

increasing a flowrate of the working fluid or a temperature of the working fluid within the working fluid circuit and circulating the working fluid by a turbopump contained within the pump system during the startup procedure;

circulating the working fluid by the turbopump during a load ramp procedure or a full load procedure subsequent to the startup procedure, such that the flowrate of the working fluid or the temperature of the working fluid sustains the turbopump during the load ramp procedure or the full load procedure; and maintaining the pressure of the working fluid at less than a critical pressure value during the load ramp procedure or the full load procedure.

2. The method of claim 1, wherein a secondary heat exchanger or a tertiary heat exchanger is configured to heat the working fluid upstream to an inlet of a drive turbine of the turbopump during the load ramp procedure or the full load procedure.

3. The method of claim 2, further comprising decreasing the pressure of the working fluid within the low pressure side of the working fluid circuit via the process control system during the load ramp procedure or the full load procedure.

4. The method of claim 3, wherein the working fluid within the low pressure side of the working fluid circuit is in a subcritical state during the load ramp procedure or the full load procedure.

5. The method of claim 4, wherein the working fluid in the subcritical state is in a liquid state.

6. The method of claim 1, wherein the working fluid comprises carbon dioxide.

7. The method of claim 1, further comprising measuring the pressure of the working fluid within the low pressure side of the working fluid circuit upstream to an inlet on a pump portion of the turbopump.

8. The method of claim 1, further comprising measuring the pressure of the working fluid downstream from a turbine outlet on the power turbine within the low pressure side of the working fluid circuit.

9. The method of claim 1, wherein the pressure of the working fluid within the low pressure side during the startup procedure is within a range from 7.38 MPa to 10.4 MPa.

10. A method for starting a heat engine, comprising:

circulating a working fluid within a working fluid circuit by a pump system, wherein the working fluid circuit has a high pressure side containing the working fluid in a supercritical state and a low pressure side containing the working fluid in a subcritical state or a supercritical state;

transferring thermal energy from a heat source stream to the working fluid by at least a primary heat exchanger fluidly coupled to and in thermal communication with the high pressure side of the working fluid circuit;

flowing the working fluid through a power turbine or through a power turbine bypass line circumventing the power turbine, wherein the power turbine is configured to convert the thermal energy from the working fluid to mechanical energy of the power turbine and the power turbine is coupled to a power generator configured to convert the mechanical energy into electrical energy;

monitoring and maintaining a pressure of the working fluid within the low pressure side of the working fluid circuit via a process control system operatively connected to the working fluid circuit, wherein the pressure of the working fluid in the low pressure side is above a critical pressure value of the working fluid during a startup procedure;

increasing a flowrate of the working fluid or a temperature of the working fluid within the working fluid circuit and circulating the working fluid by a turbopump contained within the pump system during the startup procedure;

circulating the working fluid by the turbopump during a load ramp procedure or a full load procedure subsequent to the startup procedure, such that the flowrate of the working fluid or the temperature of the working fluid sustains the turbopump during the load ramp procedure or the full load procedure; and maintaining the pressure of the working fluid at less than the critical pressure value during the load ramp procedure or the full load procedure.

11. The method of claim 10, wherein the pressure of the working fluid within the low pressure side during the startup procedure is within a range from 7.38 MPa to 10.4 MPa.

12. A method for starting a heat engine, comprising:

circulating a working fluid within a working fluid circuit by a pump system, wherein the working fluid circuit has a high pressure side containing the working fluid in a supercritical state, a low pressure side containing the working fluid in a subcritical state or a supercritical state, and the pump system contains at least a turbopump;

transferring thermal energy from a heat source stream to the working fluid by at least a primary heat exchanger fluidly coupled to and in thermal communication with the high pressure side of the working fluid circuit;

flowing the working fluid through a power turbine or through a power turbine bypass line circumventing the power turbine, wherein the power turbine is configured to convert the thermal energy from the working fluid to mechanical energy of the power turbine and the power turbine is coupled to a power generator configured to convert the mechanical energy into electrical energy;

monitoring and maintaining a pressure of the working fluid within the low pressure side of the working fluid circuit upstream to an inlet on a pump portion of the turbopump via a process control system operatively connected to the working fluid circuit, wherein the inlet on the pump portion of the turbopump and the low pressure side of the working fluid circuit contain the working fluid in the supercritical state during a startup procedure;

increasing a flowrate of the working fluid or a temperature of the working fluid within the working fluid circuit and circulating the working fluid by the turbopump contained within the pump system during the startup procedure;

circulating the working fluid by the turbopump during a load ramp procedure or a full load procedure subsequent to the startup procedure, such that the flowrate of the working fluid or the temperature of the working fluid sustains the turbopump during the load ramp procedure or the full load procedure; and maintaining the pressure of the working fluid at less than a critical pressure value during the load ramp procedure or the full load procedure.

* * * * *